US012385273B2

(12) United States Patent
Sebor et al.

(10) Patent No.: US 12,385,273 B2
(45) **Date of Patent: *Aug. 12, 2025**

(54) TURBINE-DRIVEN SWIMMING POOL CLEANING APPARATUS

(71) Applicants: Pavel Sebor, Heathrow, FL (US); Robert Sebor, Lake Mary, FL (US)

(72) Inventors: Pavel Sebor, Heathrow, FL (US); Robert Sebor, Lake Mary, FL (US)

( * ) Notice: Subject to any disclaimer, the term of this patent is extended or adjusted under 35 U.S.C. 154(b) by 544 days.

This patent is subject to a terminal disclaimer.

(21) Appl. No.: 17/840,147

(22) Filed: Jun. 14, 2022

(65) Prior Publication Data

US 2022/0307280 A1 Sep. 29, 2022

Related U.S. Application Data

(63) Continuation of application No. 16/813,665, filed on Mar. 9, 2020, now Pat. No. 11,359,398, which is a continuation of application No. 16/156,629, filed on Oct. 10, 2018, now Pat. No. 10,584,507, which is a continuation of application No. 15/891,786, filed on Feb. 8, 2018, now Pat. No. 10,145,137, which is a continuation of application No. 14/976,404, filed on Dec. 21, 2015, now Pat. No. 10,036,175, which is a continuation-in-part of application No. 14/685,861, filed on Apr. 14, 2015, now Pat. No. 9,217,260, which is a continuation of application No. 14/017,758, filed on Sep. 4, 2013, now Pat. No. 9,032,575.

(60) Provisional application No. 61/720,208, filed on Oct. 30, 2012.

(51) Int. Cl.
*E04H 4/16* (2006.01)

(52) U.S. Cl.
CPC ..... *E04H 4/1654* (2013.01)

(58) Field of Classification Search
CPC ..... E04H 4/1654
USPC ..... 15/1.7
See application file for complete search history.

(56) References Cited

U.S. PATENT DOCUMENTS

| | | | |
|---|---|---|---|
| 747,574 | A | 12/1903 | Bacharach |
| 2,556,022 | A | 6/1951 | Atiyeh |
| 2,641,015 | A | 6/1953 | Lovick |
| 2,846,711 | A | 8/1958 | Brace |

(Continued)

FOREIGN PATENT DOCUMENTS

| | | | |
|---|---|---|---|
| FR | 2584442 | A | 1/1987 |
| FR | 2925557 | A | 6/2009 |
| WO | 2011161389 | A1 | 12/2011 |

*Primary Examiner* — Tom Rodgers
(74) *Attorney, Agent, or Firm* — GrayRobinson, P.A.

(57) ABSTRACT

A swimming pool cleaner is driven along a submerged surface by water and debris flowing past a turbine positioned between an inlet and outlet of the cleaner. Retractable elements carried proximate the inlet form a plenum for water to enhance adherence of the pool cleaner to the submerged pool surface being cleaner. A drive train independently drives each of two wheels for maneuvering the pool cleaner in forward and reverse directions along the submerged surface. A hose connector operable with an outlet port is angled toward the forward direction of movement of the pool cleaner such that a suction hose will be placed slightly ahead of the pool cleaner when climbing a side wall surface to provide a weight for keeping the cleaner below the water surface and thus prevent an undesirable sucking of air at the inlet.

23 Claims, 21 Drawing Sheets

(56) References Cited

U.S. PATENT DOCUMENTS 3,019,462 A 2/1962 Jacuzzi et al.
3,074,087 A 1/1963 Drennan
3,795,027 A 3/1974 Lindberg
3,950,809 A 4/1976 Schatzmann
3,959,838 A 6/1976 Hannah
3,960,809 A 6/1976 Ramey et al.
4,254,525 A 3/1981 Combest
4,304,022 A 12/1981 Sommer
4,498,206 A 2/1985 Braukmann
4,536,908 A 8/1985 Raubenheimer
4,589,986 A 5/1986 Greskovics et al.
4,656,683 A 4/1987 Raubenheimer
4,683,599 A 8/1987 Rief
4,722,110 A 2/1988 Chandler
4,817,991 A 4/1989 Frentzel et al.
D304,505 S 11/1989 Maier et al.
4,920,599 A 5/1990 Rief
5,001,800 A 3/1991 Parenti et al.
5,033,149 A 7/1991 Russo
5,097,559 A 3/1992 Brunt et al.
5,099,535 A 3/1992 Chayvuer et al.
5,172,445 A * 12/1992 Chandler ..... E04H 4/1654 15/387
5,197,158 A 3/1993 Moini
5,293,659 A 3/1994 Rief et al.
5,337,434 A 8/1994 Erlich
5,351,355 A 10/1994 Chiniara
5,363,877 A 11/1994 Frentzel et al.
5,379,473 A 1/1995 Rief et al.
5,428,854 A 7/1995 Rief et al.
5,454,129 A 10/1995 Kell
5,469,596 A 11/1995 Rief et al.
5,554,277 A 9/1996 Rief et al.
5,557,822 A 9/1996 Yagi et al.
D376,450 S 12/1996 Campbell et al.
5,604,950 A 2/1997 Stern
5,617,600 A 4/1997 Frattini
5,799,351 A 9/1998 Rief et al.
5,933,899 A 8/1999 Campbell et al.
D417,047 S 11/1999 Tsuda
D418,640 S 1/2000 Veloskey et al.
D421,512 S 3/2000 Campbell
D429,393 S 8/2000 Rief et al.
6,115,864 A 9/2000 Davidsson et al.
6,131,227 A 10/2000 Rief et al.
D433,545 S 11/2000 Hollinger et al.
6,155,657 A 12/2000 Erlich et al.
6,199,237 B1 3/2001 Budden
6,212,725 B1 4/2001 Porat
6,237,175 B1 5/2001 Phillipson et al.
D443,737 S 6/2001 Rief et al.
D444,280 S 6/2001 Rief et al.
D445,225 S 7/2001 Schaub
6,289,918 B1 9/2001 Rief et al.
6,292,970 B1 9/2001 Rief et al.
6,298,513 B1 10/2001 Rief et al.
D456,101 S 4/2002 Lee
6,460,564 B1 10/2002 Rief et al.
6,473,927 B1 11/2002 Sommer
D469,589 S 1/2003 Wichmann et al.
D471,330 S 3/2003 Campbell
6,560,808 B2 5/2003 Phillipson et al.
6,564,417 B2 5/2003 Porat
6,665,900 B2 12/2003 Wichmann et al.
6,691,811 B2 2/2004 Damrath
6,706,175 B1 3/2004 Rief et al.
D489,150 S 4/2004 Campbell
6,733,046 B1 5/2004 Rief
6,782,578 B1 8/2004 Rief et al.
6,820,297 B2 11/2004 Phillipson et al.
6,854,148 B1 2/2005 Rief et al.
6,886,205 B1 5/2005 Pichon
6,942,790 B1 9/2005 Dolton
6,954,960 B2 10/2005 Pichon
D521,696 S 5/2006 Choi
7,117,554 B2 10/2006 Pichon
7,118,632 B2 10/2006 Sumonthee
7,293,314 B2 11/2007 Henkin et al.
D575,915 S 8/2008 Dreyer
D580,114 S 11/2008 Rummel
7,464,429 B2 12/2008 Stoltz
7,506,770 B2 3/2009 Rief
7,520,282 B2 4/2009 Stoltz
D594,610 S 6/2009 Klimas
D599,967 S 9/2009 Blanc-Tailleur
7,805,792 B2 10/2010 Roumagnac
7,849,547 B2 12/2010 Erlich et al.
7,908,697 B2 3/2011 Lavabre et al.
7,945,981 B2 5/2011 Lapping
D670,462 S 11/2012 Mastio et al.
8,307,485 B2 11/2012 Sumonthee
8,341,789 B2 1/2013 Garti
8,402,585 B2 3/2013 Rief et al.
8,402,586 B2 3/2013 Lavabre
8,424,142 B2 4/2013 Garti
D684,738 S 6/2013 Richiuso et al.
8,474,081 B2 7/2013 Stoltz
8,561,240 B2 10/2013 Hui
8,784,652 B2 7/2014 Rief et al.
8,869,337 B2 10/2014 Sumonthee
D721,460 S 1/2015 Hanan et al.
D728,873 S 5/2015 Renaud et al.
D730,598 S 5/2015 Meyer et al.
9,032,575 B2 * 5/2015 Sebor ..... E04H 4/1654 15/1.7
D733,374 S 6/2015 Richiuso et al.
9,217,260 B2 * 12/2015 Sebor ..... E04H 4/1654
D747,573 S 1/2016 Richiuso et al.
D787,761 S 5/2017 Mainville et al.
D788,860 S 6/2017 Kalogiros et al.
9,675,913 B1 6/2017 Sebor et al.
10,584,507 B2 * 3/2020 Sebor ..... E04H 4/1654
2003/0224889 A1 12/2003 Luh
2004/0074024 A1 4/2004 Bavoso
2006/0143841 A1 7/2006 Niewiarowski
2008/0092322 A1 4/2008 Halle et al.
2008/0222821 A1 9/2008 Pichon
2008/0244842 A1 10/2008 Lavabre et al.
2009/0229061 A1 9/2009 Stoltz et al.
2009/0300862 A1 12/2009 Schneider et al.
2010/0299863 A1 12/2010 Dewing
2011/0088181 A1 4/2011 Rief et al.
2011/0154585 A1 6/2011 Mastio et al.
2011/0154586 A1 6/2011 Mastio et al.
2011/0314617 A1 12/2011 Van Der et al.
2012/0060307 A1 3/2012 Stoltz
2012/0144605 A1 6/2012 Dewings
2012/0210527 A1 8/2012 Erlich et al.
2013/0031729 A1 2/2013 Bernini
2013/0031734 A1 2/2013 Porat et al.
2013/0152316 A1 6/2013 Rief et al.

* cited by examiner

TURBINE-DRIVEN SWIMMING POOL CLEANING APPARATUS

CROSS REFERENCE TO RELATED APPLICATIONS

This is a continuation of U.S. patent application Ser. No. 16/813,665, filed Mar. 9, 2020, now U.S. Pat. No. 11,359,398, which is a continuation of U.S. patent application Ser. No. 16/156,629, filed Oct. 10, 2018, now U.S. Pat. No. 10,584,507, which is a continuation of U.S. patent application Ser. No. 15/891,786, filed Feb. 8, 2018, now U.S. Pat. No. 10,145,137, which is a continuation of U.S. patent application Ser. No. 14/976,404, filed Dec. 21, 2015, now U.S. Pat. No. 10,036,175, which is a continuation-in-part application of U.S. patent application Ser. No. 14/685,861, filed Apr. 14, 2015, now U.S. Pat. No. 9,217,260 which is a continuation of U.S. patent application Ser. No. 14/017,758, filed Sep. 4, 2013, now U.S. Pat. No. 9,032,575, which claims priority to U.S. Provisional Patent Application Ser. No. 61/720,208, filed Oct. 30, 2012 for Turbine-Driven Swimming Pool Cleaning Apparatus and Method, the disclosures of which are hereby incorporated by reference herein in their entirety.

FIELD OF INVENTION

The present invention generally relates to swimming pool cleaners, and more particularly to an automatic pool cleaner driven by a flow of water through a turbine engine for providing movement along and cleaning of submerged surfaces to be cleaned.

BACKGROUND

Submersible pool cleaners having driving mechanisms carried within a housing that engages the submerged surface of the pool are generally well known, such as the three or four wheeled swimming pool pressure cleaners with internal steering mechanism described in U.S. Pat. Nos. 6,782,578 and 6,854,148 to Rief et al., the disclosures of which are herein incorporated by reference in their entirety. Various pool cleaners are turbine driven, as in the aforementioned patents, including a turbine motor as described in U.S. Pat. No. 6,292,970, the disclosures of which are herein incorporated by reference in their entirety. Further, also generally known are the problems associated with debris clogging fluid flow passages, wearing cleaner components rendering the cleaner ineffective or unusable, and the difficulty for a consumer attempting to replace such worn components.

As is well known, and as emphasized in U.S. Pat. No. 6,131,227 to Rief et al, the disclosure of which is herein incorporated by reference in its entirety, the proper functioning of swimming pool cleaners typically relies on a skirt bordering and extending downwardly from the body of the pool cleaner. The skirt generally maintains an effective fluid suction within a plenum of water proximate the inlet to the cleaner, generally dislodges loose debris, accommodates uneven surfaces, provides a fluid suction force to keep the pool cleaner pressed against the submerged surface and yet allow the pool cleaner to travel up and across submerged steeply inclined and vertical surfaces.

There remains a need to improve upon performance of the submersible pool cleaner such that the pool cleaner can effectively and efficiently automatically navigate over obstacles such as bottom drains and larger debris, and be able to upright itself in the event it should fall on its back.

Yet further, when debris flows through the turbine, it is desirable to have the debris work its way through the cleaner while maintaining maximum power without compromising function, and without having to stop automatic operation and access the housing to clean the debris. Those experienced with submersible pool cleaners appreciate that it is desirable to keep the cleaner below the water surface to prevent it from sucking air as it climbs vertical walls of the pool.

Embodiments of the present invention herein described provide an efficiently run submersible cleaner which includes components that are easily replaceable by the consumer and operate to meet such needs.

SUMMARY

By way of example, submersible pool cleaners according to the teachings of the present invention may comprise a turbine motor driven by a flow of water for operation of the pool cleaner along a submerged surface to be cleaned. The turbine comprises a turbine housing having a rotor rotatably mounted in a chamber to provide a flow path for water and debris around the rotor. Turbine vanes may be rigidly attached about and extend from a periphery of the turbine rotor. A valve element may be located proximate the vanes and inlet port such that the valve element is movable with respect to distal ends of the turbine vanes to allow passage of debris of substantial size through the turbine. The pool cleaner may include a roller positioned on a bottom forward portion thereof proximate the inlet port and a retractable element, such as an elongate flap or second roller, pivotably carried by the pool cleaner and positioned on a bottom rearward portion proximate the inlet port. The roller and retractable element, in combination with walls of the housing of the cleaner, form a plenum of water enhancing adherence of the pool cleaner to the pool surface.

A hose connector operable with an outlet port is angled toward the forward direction of movement of the pool cleaner such that a hose connected to the hose connector will be placed slightly ahead of the pool cleaner when climbing a side wall surface. A water filled hose provides weight for keeping the cleaner below the water surface and thus prevents a sucking of air at an inlet port.

BRIEF DESCRIPTION OF DRAWINGS

For a fuller understanding of the invention, reference is made to the following detailed description, taken in connection with the accompanying drawings illustrating various embodiments of the present invention, in which.

DETAILED DESCRIPTION OF EMBODIMENTS

Figure 1:
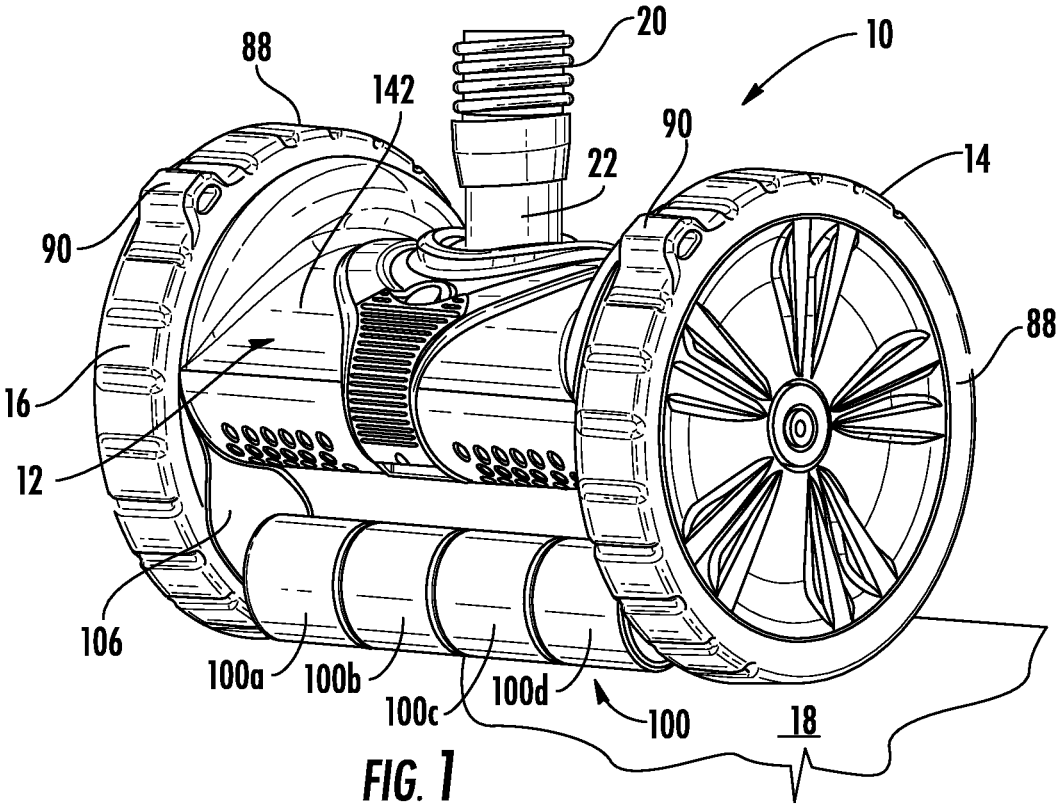
FIG. 1 is a top, front right perspective view of one embodiment of a submersible swimming pool cleaner according to the teachings of the present invention.
Figure 2:
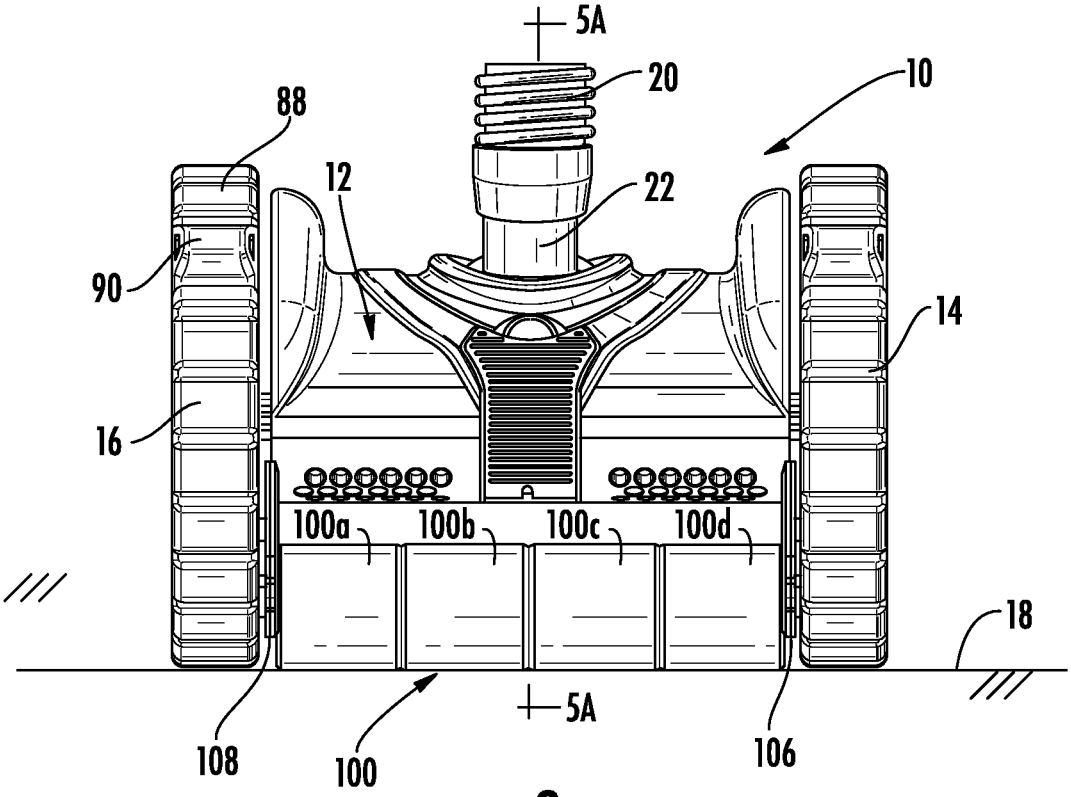
FIG. 2 is a front elevation view of the submersible swimming pool cleaner illustrated in FIG. 1.
Figure 3:
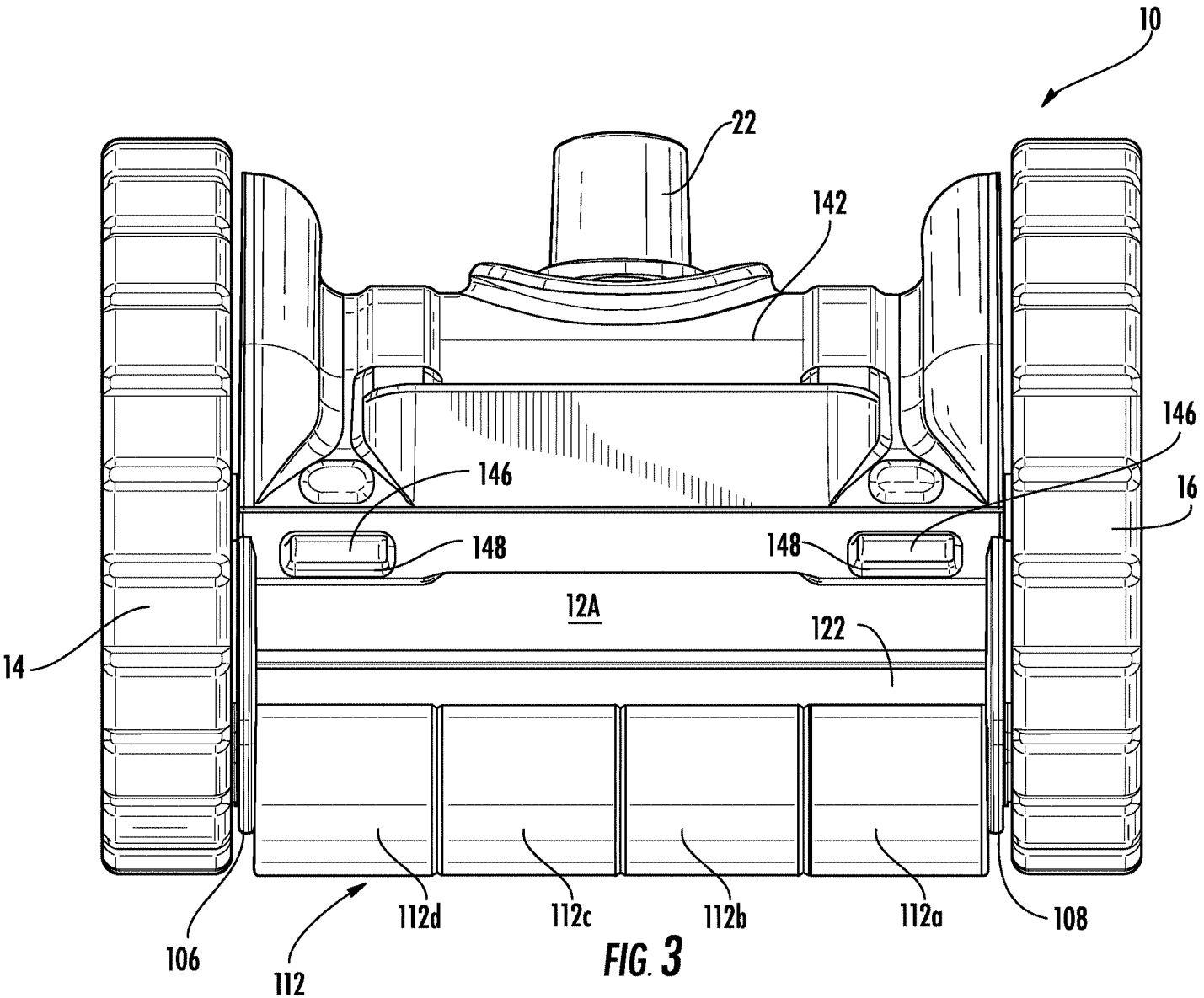
FIG. 3 is a rear elevation view of the embodiment of FIG. 1.
Figure 3A:
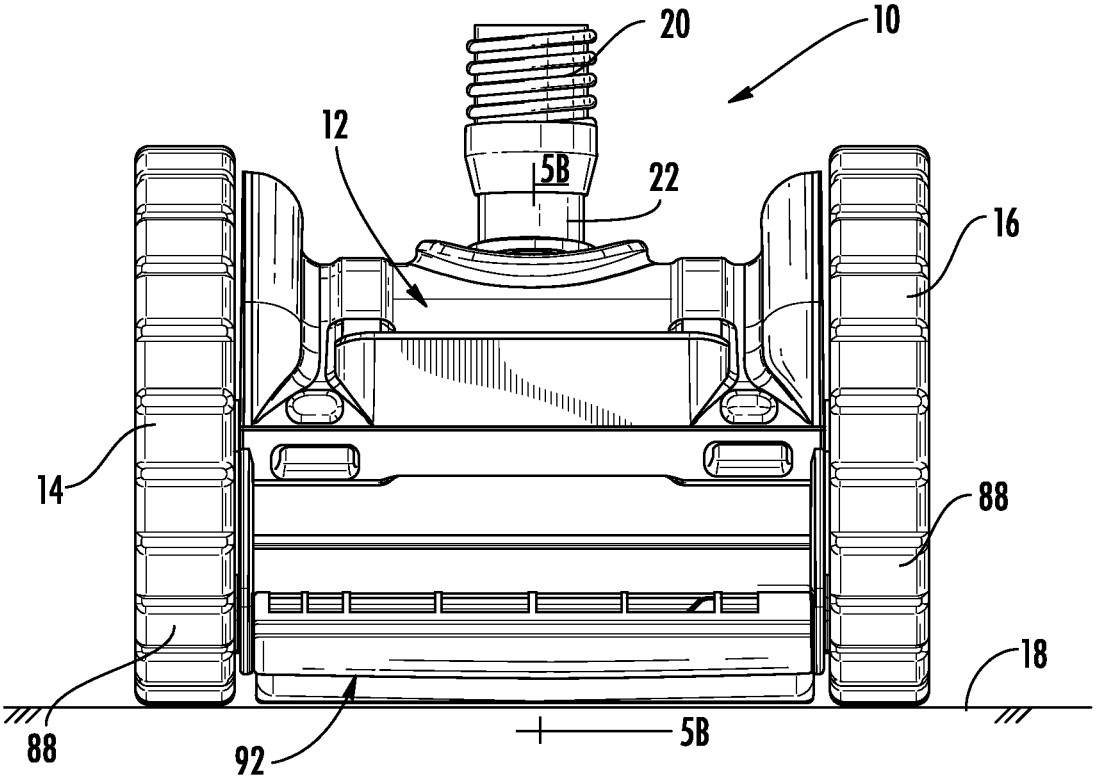
FIG. 3A is a rear elevation view of an alternate embodiment of FIG. 1, wherein a rear roller is replaced with a wiper element, such as a flap, by way of example.

The present invention will now be described more fully hereinafter with reference to the accompanying drawings, in which preferred embodiments of the invention are shown by way of example only. This invention may be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring initially to FIGS. 1-4, one embodiment of a pool cleaner 10 according to the teachings of the present invention is herein described by way of example. The pool cleaner 10 comprises a housing 12 and first and second wheels 14, 16 for moving the pool cleaner over a submerged surface 18 to be cleaned. The pool cleaner 10 is operable with a hose 20 connected to a hose connector 22 at one end and optionally to a suction pump (not shown) at another end of the hose, as typically known in the industry.

As illustrated with reference to FIG. 5, a driving function is provided to the pool cleaner 10 by a water turbine 24 carried within a turbine housing 26. The turbine housing 26 includes a water flow chamber 28 formed by a chamber wall 30, as illustrated with reference to FIG. 6, wherein a turbine housing cover 27, illustrated earlier with reference to FIG. 5, has been removed for clarity. The water flow chamber 28 includes inlet and outlet ports 32, 34 allowing a flow of water 36 through the chamber. The inlet port 32 is positioned for receiving water and debris from the submerged pool surface 18.

Figure 5:
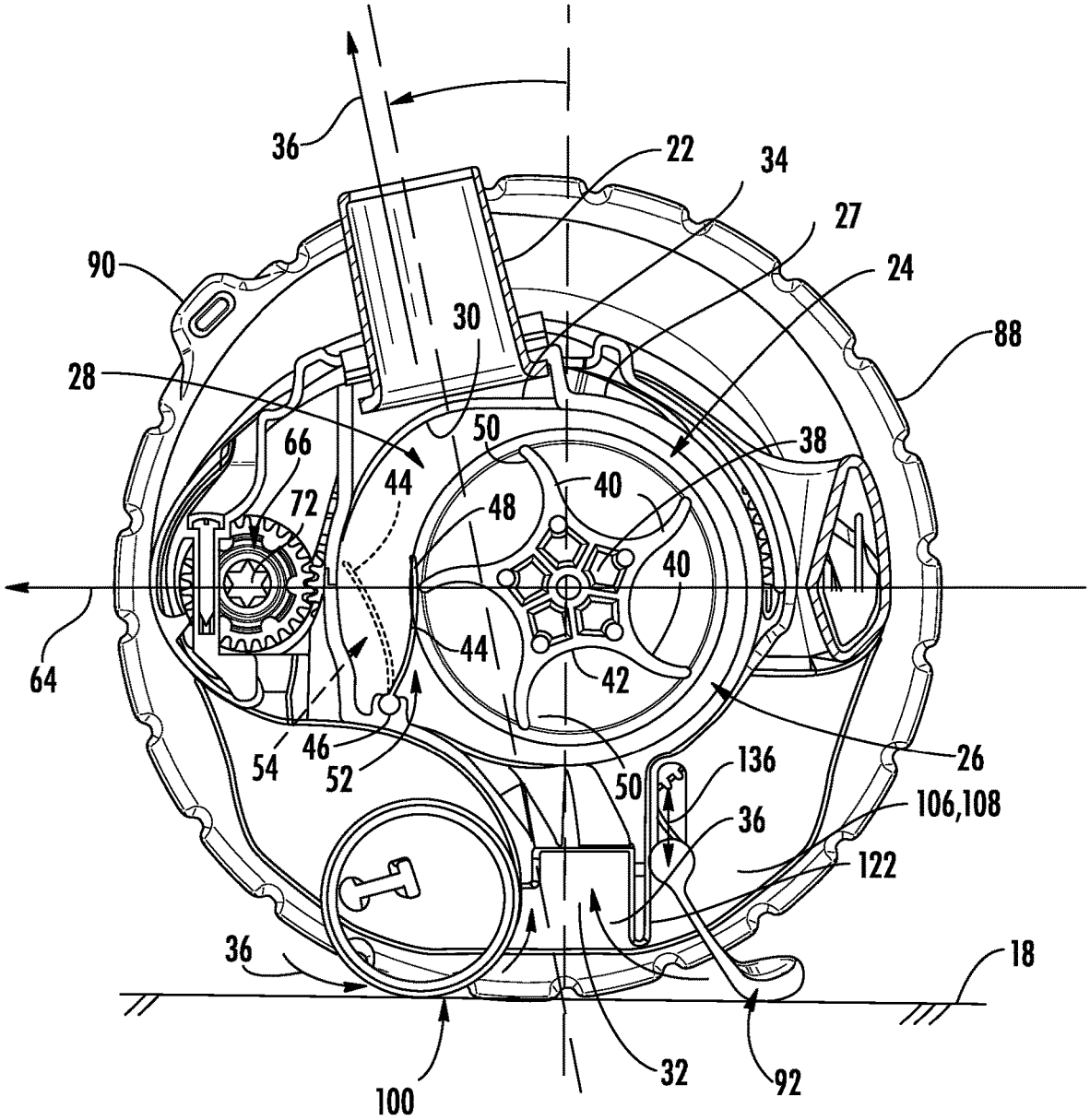
FIG. 5 is a cross-sectional view taken through lines 5B-5B of FIG. 3A.
Figure 6:
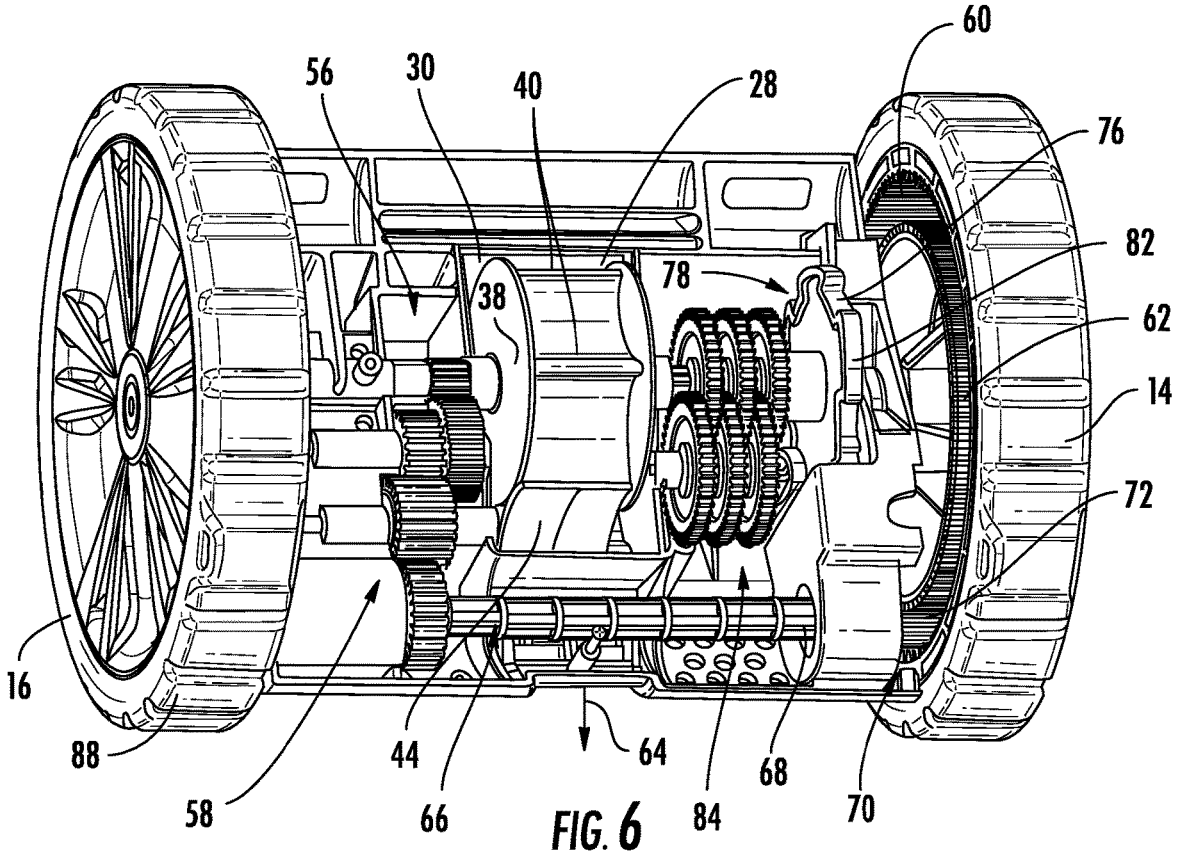
FIG. 6 is a top perspective view of the embodiment of FIG. 5 illustrated with the turbine housing cover and hose connector removed for more clearly viewing the turbine.

With continued reference to FIGS. 5 and 6, a rotor 38 is rotatably mounted in the chamber 28 and spaced from the chamber wall 30 at all positions about the rotor to provide a flow path, as illustrated reference to the water flow 36 for water and debris around the rotor. A plurality of turbine rigid vanes 40 are rigidly attached about and extend from a periphery 42 of the rotor 38. As herein described, the rigid vanes 40 will be understood to have sufficient flexibility to accommodate passage of debris through the inlet port 32 without blockage, yet sufficiently rigid to accommodate volumes of water moving through the turbine chamber 28 for rotating the rotor 38. Many materials will come to the mind of those skilled in the art, now having the benefit of the teachings of the present invention. For the embodiment herein described by way of example, a valve element 44 is pivotal about a proximal end 46 of the valve element such that a distal end 48 is movable with respect to distal ends 50 of the turbine vanes 40. However, the valve element 44 may be flexible and fixed at its proximal end. The valve element 44 may be straight or have an arcuate shape. The valve element 44 is moveable between a first position 52 adjacent the vanes' distal ends 50 during rotation thereof and a second position 54 spaced from the vanes' distal ends and closer to the chamber wall 30 to allow passage of debris pieces of substantial size through the turbine 24. For the embodiment herein described by way of example, the valve element 44 is contoured creating less pressure on its convex side proximate the vanes 40 when water flows over it, causing the valve element 44 to close a gap between the valve element and the vane distal ends 50 to maximizes power generated by the turbine 24. The valve element 44 and rotor 38 generally define a preferable opening for the flow passage through the chamber 28. The turbine 24 provides power to the wheels 14, 16 through linkages and provides power for steering, both of which occur as water and debris are drawn through the chamber 28 by the action of the suction pump.

Figure 7:
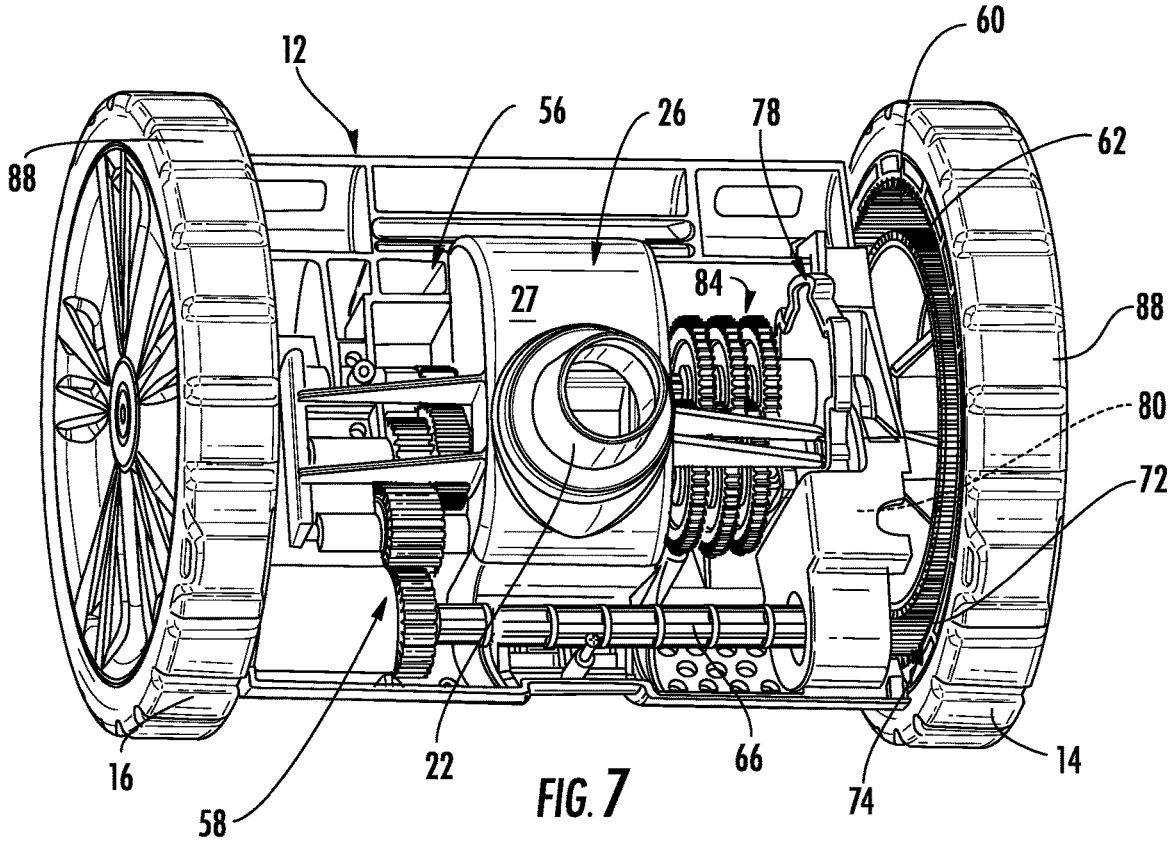
FIG. 7 is a partial top perspective view of the swimming pool cleaner of FIG. 1 illustrated with a top removable housing cover portion removed from the housing.

The pool cleaner 10 includes a drive assembly 56 which uses the flow of water through the chamber 28 to create the rotary motion of the turbine 24 which is transferred to the wheels 14, 16 by a drive train 58 as illustrated with continued reference to FIG. 6 and now to FIG. 7. As is typical for such swimming pool cleaners, the flexible hose 20, described earlier with reference to FIG. 1, may be rotatably attached to the hose connector 22 and draws water from beneath the pool cleaner through the inlet port 32, turbine 24 and outlet port 34 through the hose connector.

As above described, the turbine 24 is the propulsion system of the pool cleaner 10. In typical pool cleaners, there is always a precise balance in the distance between the turbine and the wall 30 housing the turbine. If the distance is to close, debris will get trapped in between. If the distance is too great the turbine 24 will lose power and will not function as desired. With reference again to FIGS. 5 and 6, one embodiment of the invention further addresses this problem with the optional self-adjusting valve element 44. When debris flows through the turbine 24, it will push the valve element 44 out of the way and as a result the debris will not get trapped. Maximum power is attained without compromising function.

Figure 10:
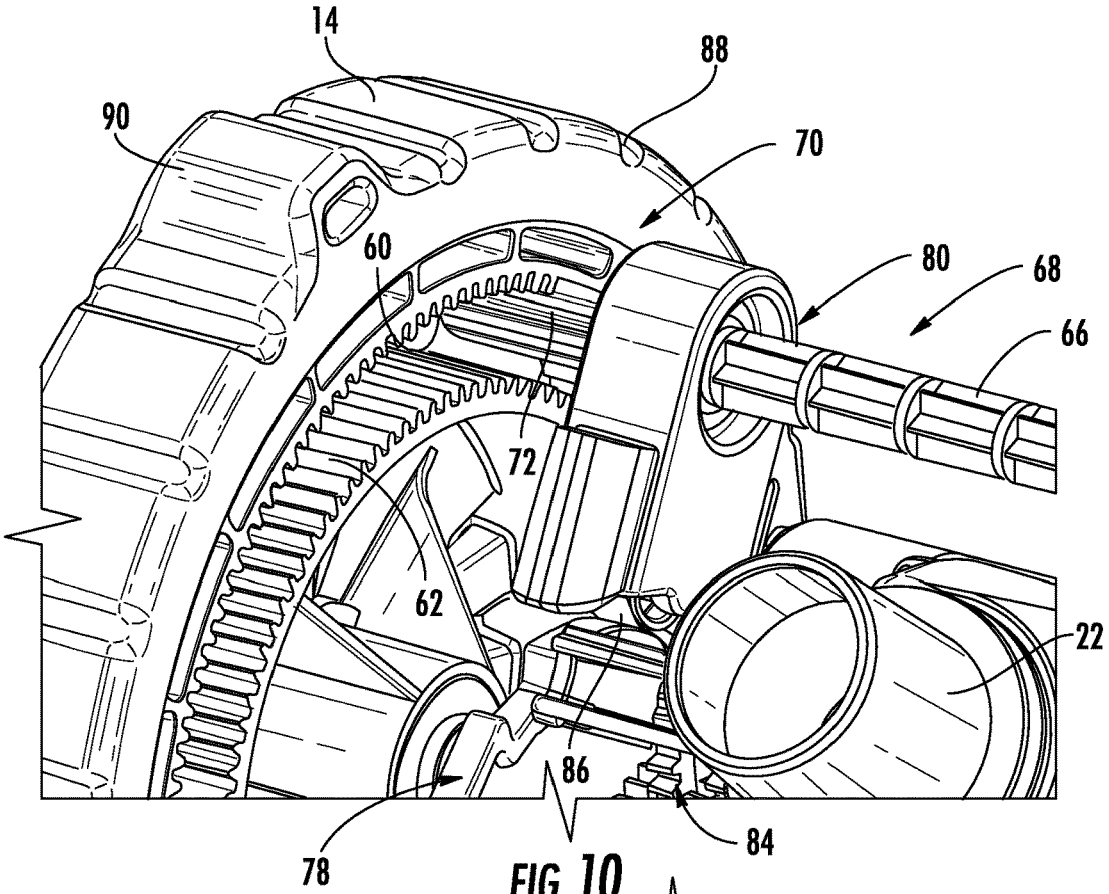
FIGS. 10 and 11 are partial perspective views illustrating a drive shaft engagement with primary and secondary wheel gears, respectively, for forward and steering rotation of one wheel.
Figure 11:
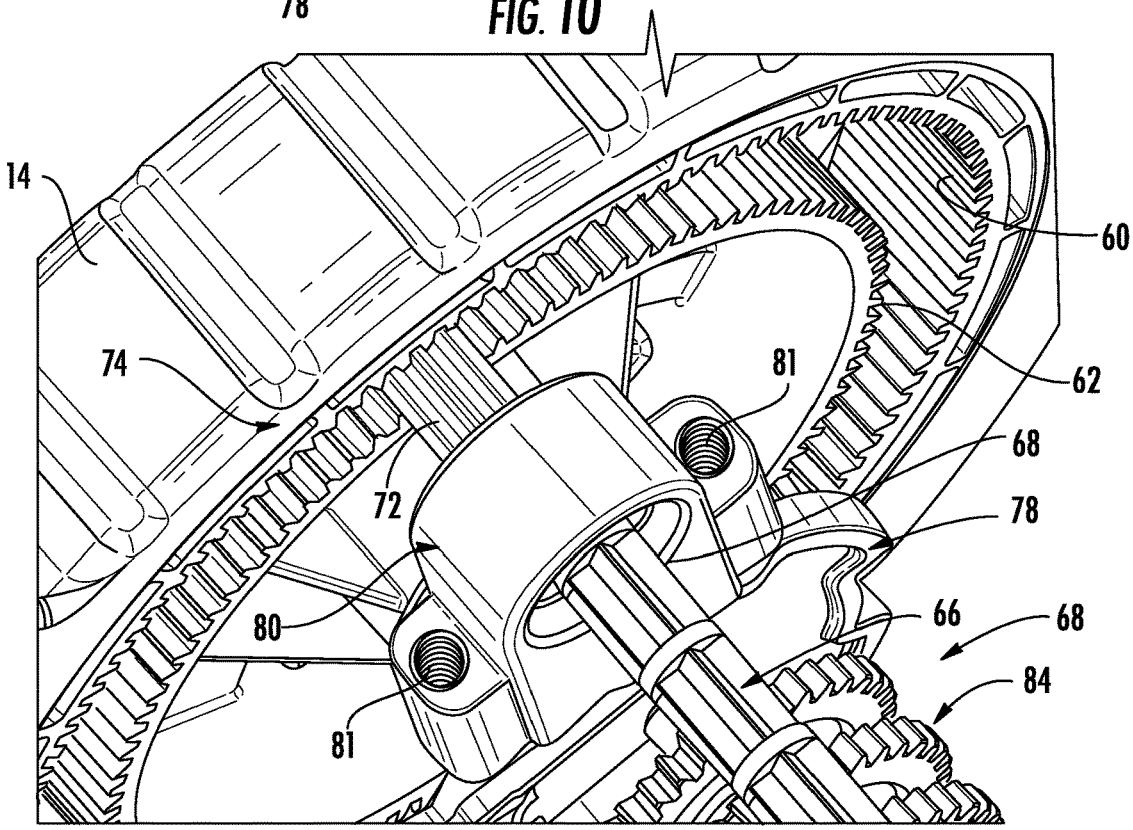

With reference again to FIG. 6, the drive train 58 operable from the rotor 38 to primary wheel gears 60 of the first and second wheels 14, 16 provides synchronous rotation to both the first and second wheels for driving the pool cleaner along the surface 18 to be cleaned. The first wheel 14 comprises the primary wheel gear 60 radially spaced from a secondary wheel gear 62 opposing one another on an inside peripheral surface of the wheel 14. The second wheel comprises the primary wheel gear 60 on an inside surface of the wheel 16, as illustrated with reference to FIGS. 8-11. Commercially, both wheels 14, 16 may comprise the primary and secondary wheel gears 60, 62 to accommodate replacement parts and efficiency in manufacturing, both wheels can be used to maneuver the cleaner in the rerouting process. For the embodiment herein illustrated with reference to FIGS. 6, 10 and 11, only the first wheel 14 is used in the rerouting process. As later described, an alternate embodiment includes independent driving and steering of each of the two wheels. Such a "dual wheel drive" may be more desirable for maneuvering the pool cleaner in a rerouting process.

Figure 12:
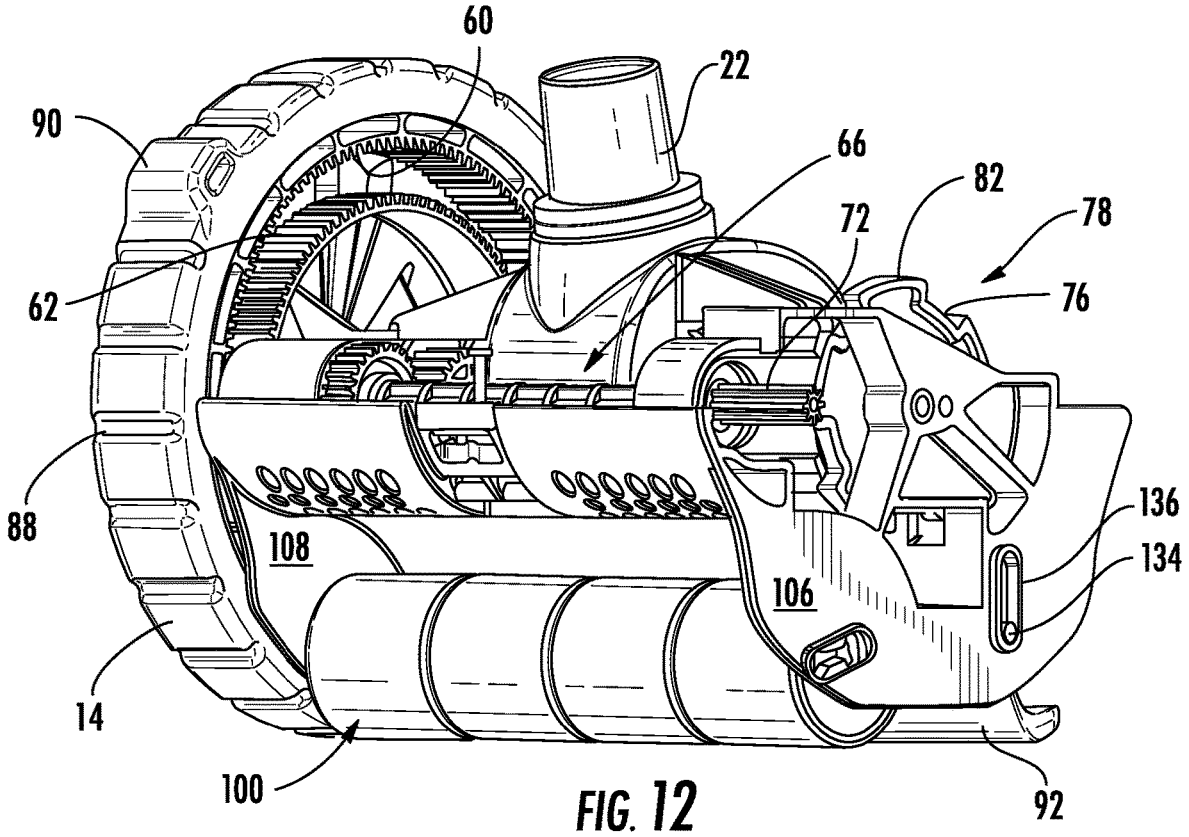
FIGS. 12 and 13 are partial perspective views illustrating a steering cam and drive shaft contactor assembly operable with the pool cleaners herein described.

With continued reference to FIG. 6, the drive train 58 is operable with both the primary wheel gears 60 of the first and second wheels 14, 16 for driving the pool cleaner 10 in a first or forward direction 64 along the submerged surface 18 of the pool, as illustrated with reference again to FIG. 1. The drive train 58 includes a drive shaft 66 having one end 68 moveable between a driving position 70 when operable with the primary wheel gears 60 of the first and second wheels 14, 16 through pinion gears 72 at ends thereof and the steering position 74 when the drive shaft 66 contacts a lesser radius portion 76 of a cam 78, as illustrated with reference again to FIGS. 9-11. Such forward and reverse wheel gears 60, 62 are radially spaced from one another by a distance in excess of the diameter of the pinion gear 72 which alternately engages such gears on the one drive wheel 14. As illustrated with reference to FIGS. 10, 11 and 12, a driveshaft contactor 80 contacts the cam 78 and the driveshaft one end 68 for movement of the one end of the driveshaft into and out of contact with the primary and secondary wheel gears 60, 62.

As above described with reference to FIG. 6, the drive train 58 is operable with both the primary wheel gears 60 of the first and second wheels 14, 16 for driving the pool cleaner 10 in a first or forward direction 64 along the submerged surface 18 of the pool, as illustrated with reference again to FIG. 1.

Figure 7A:
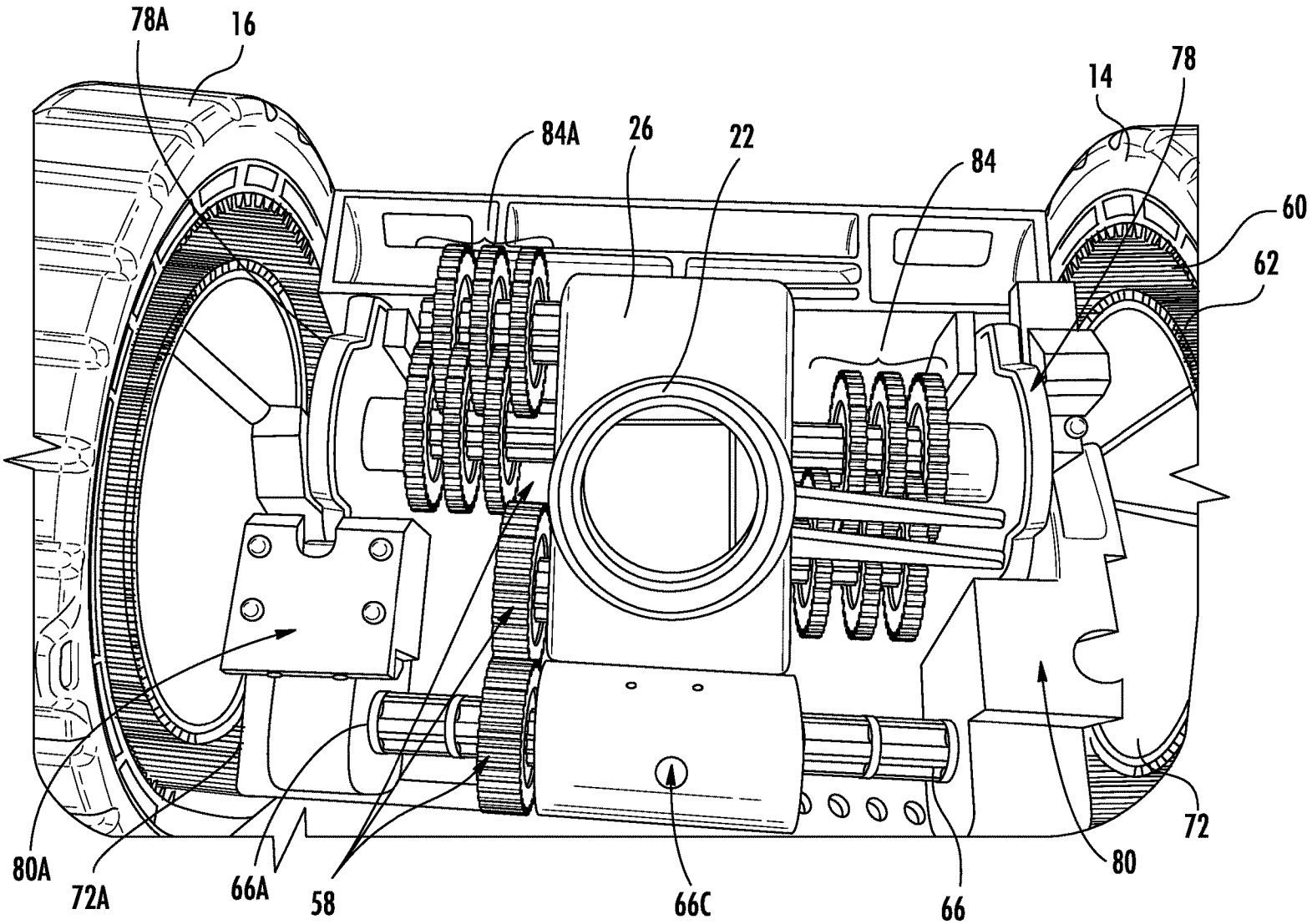
FIG. 7A is a partial top perspective view of an alternate embodiment of the swimming pool cleaner of FIG. 1 employing an independently operated dual drive system herein illustrated with the top removable housing cover portion removed from the housing.
Figure 8:
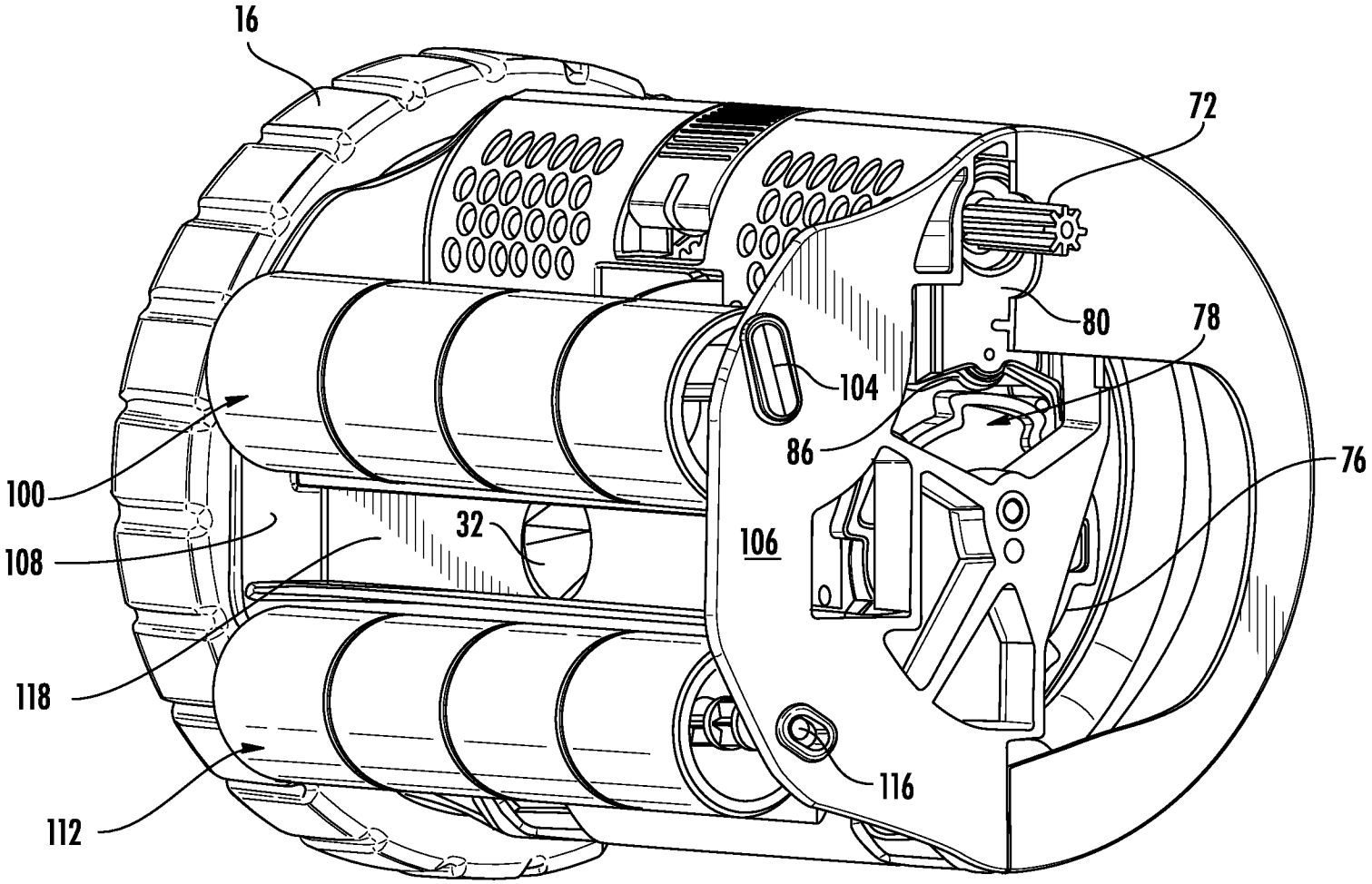
FIG. 8 is a bottom side perspective view of a partial embodiment of FIG. 1 having a wheel removed for viewing internal components.
Figure 10A:
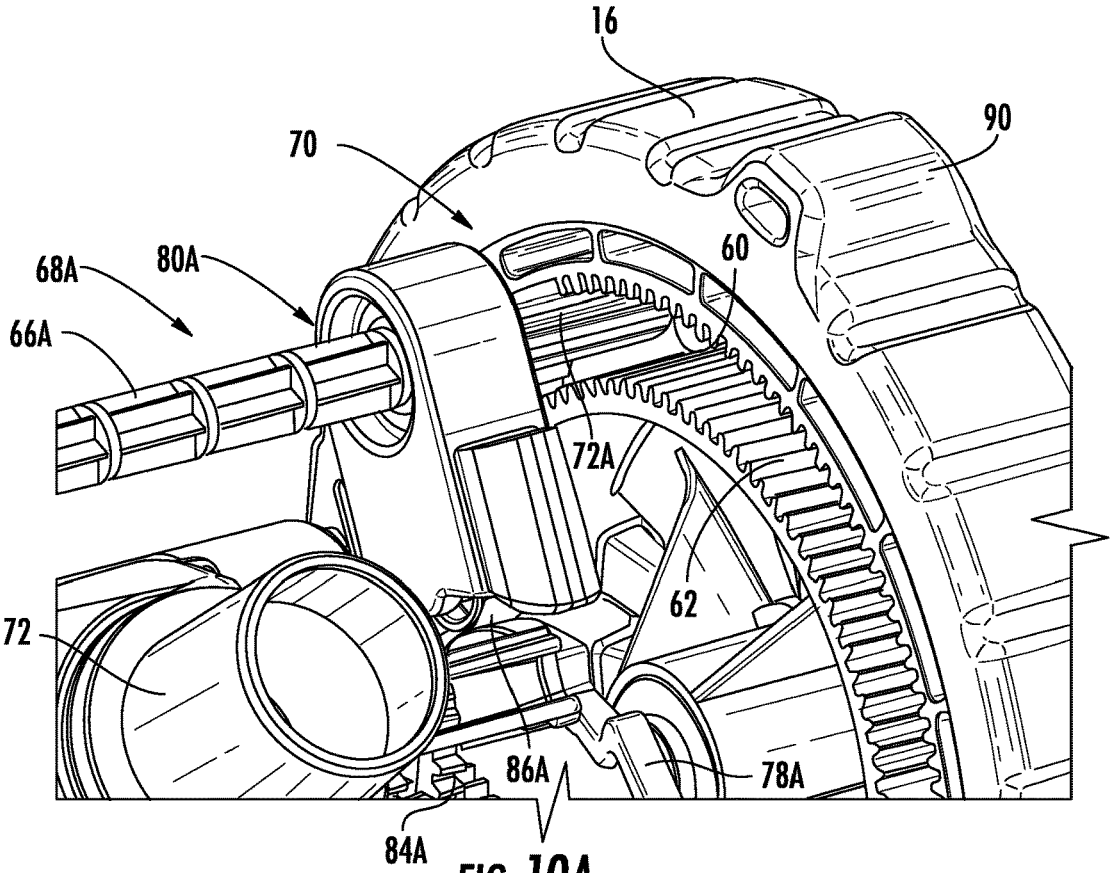
FIGS. 10A and 11A are partial perspective views of the embodiment of FIG. 7A, illustrating a drive shaft engagement with primary and secondary wheel gears, respectively, for forward and steering rotation of a second wheel within a two-wheel drive embodiment herein described by way of example.
Figure 11A:
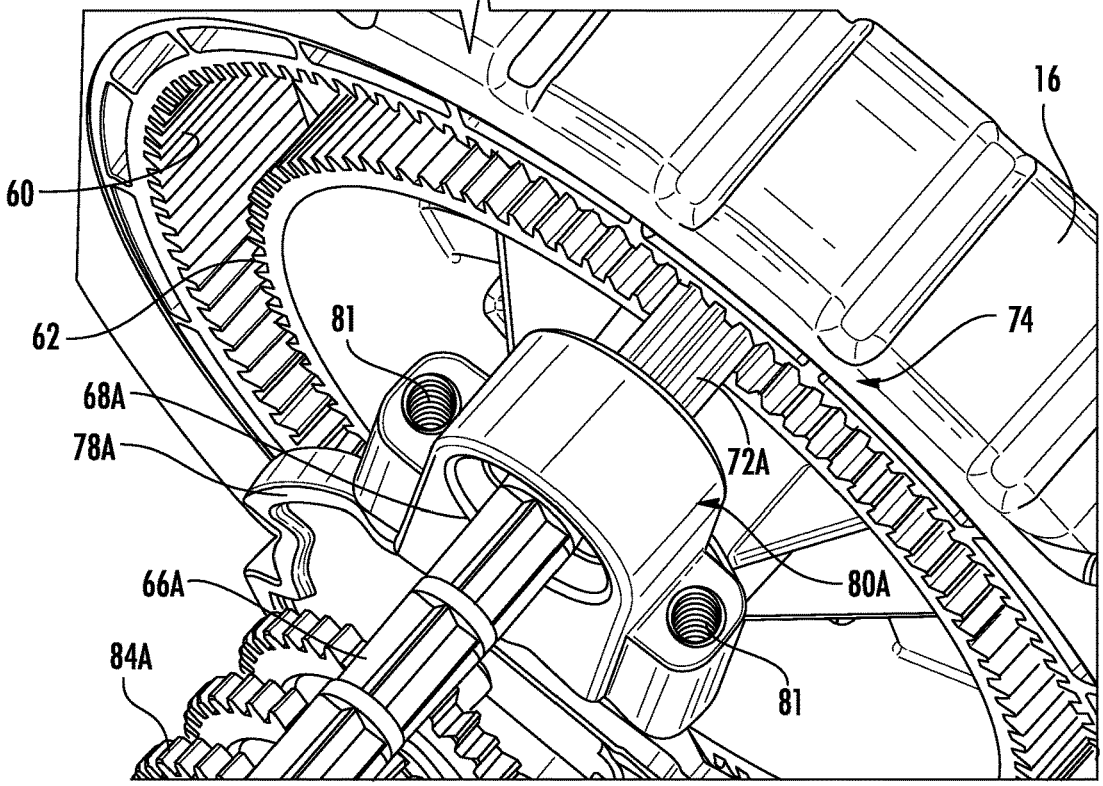

In an alternate embodiment, now described with reference to FIGS. 7A, 10A and 11A, the drive shaft 66 earlier described may be split between a left shaft portion 66 and a right shaft portion 66A employing bearings 66C that enable each portion of the split drive shaft to be manipulated independently and synchronously driven as desired. The drive gears 58 are driven by the turbine and in turn drive the drive shaft portions 66, 66A communicating through the bearings 66C. The left and right reductions gears 84, 84A control rotation of the cams 78, 78A rotate, wherein each cam (Left and right) manipulates bearings in the drive shaft contactors 80, 80A which in turn move the drive shafts 66, 66A forwards and backwards engaging the teeth on the inner and outer wheel gears 60, 62. The drive shaft 66, 66A has both ends 68, 68A moveable between the driving position 70 when operable with the primary wheel gears 60 of the first and second wheels 14, 16 through pinion gears 72, 72A at ends thereof and the steering position 74 when the drive shaft 66, 66A contacts a lesser radius portion 76 of a cam 78, as illustrated with reference again to FIGS. 10, 10A, 11, and 11A. Such forward and reverse wheel gears 60, 62 are radially spaced from one another by a distance in excess of the diameter of the pinion gears 72, 72A which alternately engage such gears on now drive wheels 14, 16. as may be desired. As illustrated with reference to FIGS. 10 and 11, and again with reference to FIGS. 7A, 10A and 11A, the driveshaft contactors 80, 80A contact the cam 78, 78A and the driveshaft ends 68, 68A for movement of ends of the driveshaft into and out of contact with the primary and secondary wheel gears 60, 62.

It will be understood by those of skill in the art that coordination of the driving functions of the two wheels will be arranged to avoid any undesirable combinations of driving and steering. Rotation of the cams 78, 78A and contacting of the pinion gears 72, 72A will be such to provide a desired driving and interrupted steering of each wheel 14, 16 without the operation of one wheel detrimental to the operation of the second wheel.

As will be appreciated by those of ordinary skill in the art, the direction of travel 64 of the pool cleaner 10 will change during the intermittent periods of a reverse rotation of the one wheel 14 by the drive shaft one end 68 driving the secondary gear 62. This steering function, together with the power provided by wheel drive provides a desired cleaning coverage of underwater pool surfaces. The dual drive embodiment drives the first and second wheels 14, 16 in a similar manner, thus effectively enabling the pool cleaner to rotate in both directions (left & right) and also travel forward and reverse.

The cams 78, 78A have portions of greater 82 and the lesser 76 radii and are rotatable by the rotor 38 of the turbine 24 through use of reduction gears 84, 84A. The drive shaft contactors 80, 80A extend from the cams 78, 78A to appropriate operable wheels 14, 16 and intermittently interrupt rotation of the wheels and reverses direction of rotation to thus cause a change in direction of movement of the pool cleaner 10.

Figure 13:
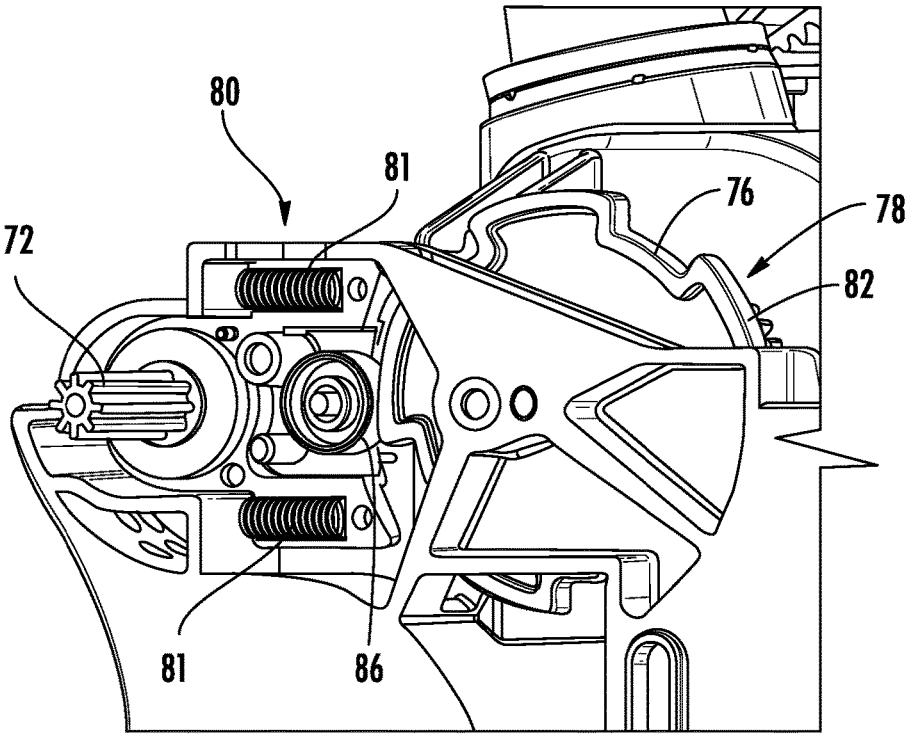
Figure 14:
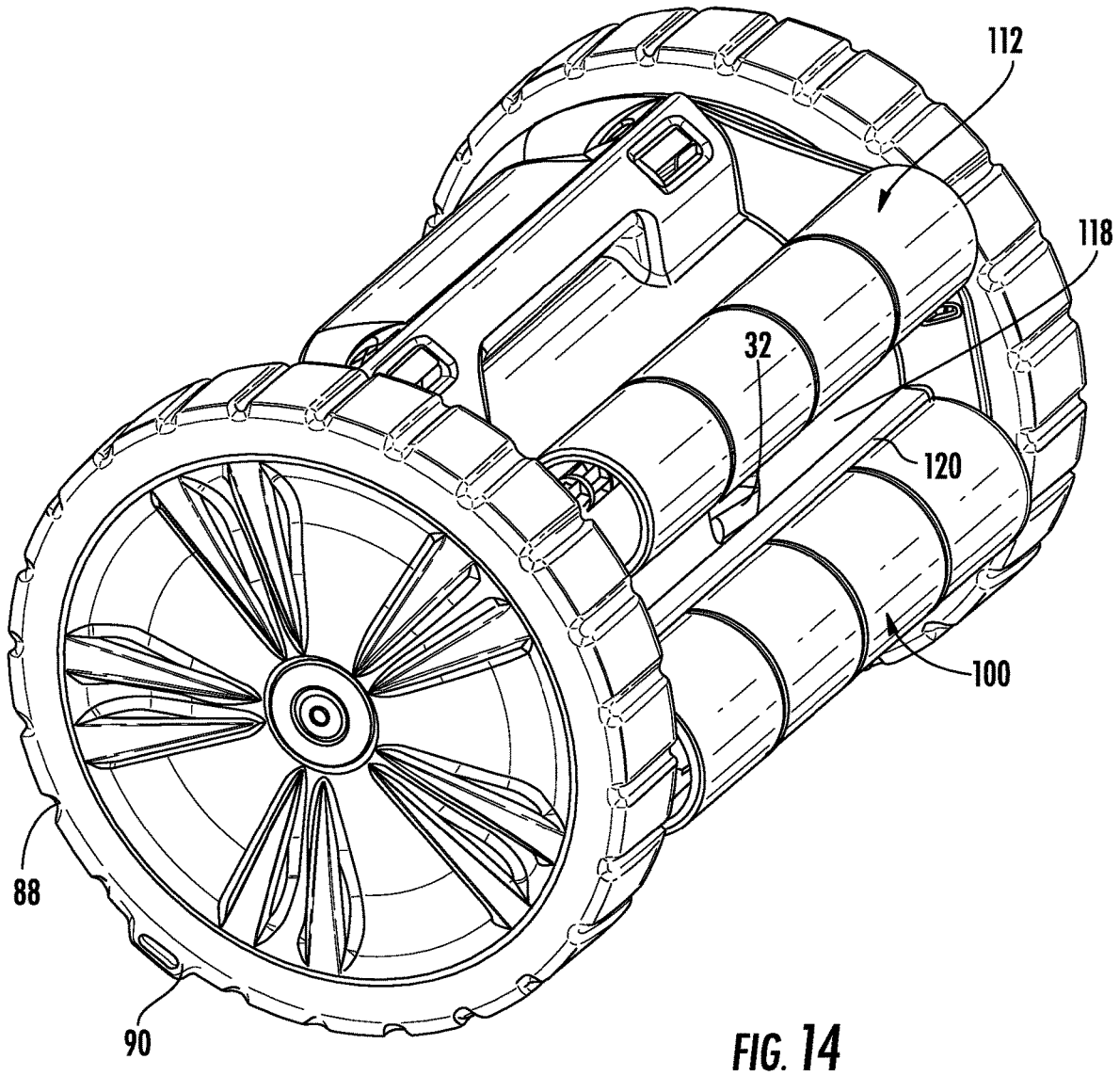
FIG. 14 is a bottom perspective view of the embodiment of FIG. 1.

Operation of the driving and steering mechanisms are similar for each wheel 14, 16 depending upon the embodiment of interest, whether using a single wheel for steering the pool cleaner of both wheels. By way of example, and with reference again to FIGS. 8, 9 and 13, a contact roller 86 (86A for the embodiment of FIGS. 10A and 11A) at one end of the drive shaft contactor 80 engages the cam 78 which determines driving and steering positions 70, 74 to provide forward or reverse movement of the wheels 14, 16. The drive shaft contactor 80 is biased into frictional engagement with the cam 78 using springs 81, as illustrated with reference to FIG. 11 (or optionally FIGS. 11A) and 13. The pinion gear 72 engages the primary wheel gear 60 of the one wheel 14 in a forward moving of the pool cleaner 10, and in a steering movement, the pinion gear engages the secondary wheel gear 62 which results in reverse rotation of the one wheel 14. As above described, optionally, it may be desirable to provide steering using a reversing of both wheels.

By way of further example, and with reference again to FIGS. 8, 9 and 13, a contact roller 86 at one end of the drive shaft contactor 80 engages the cam 78 which determines driving and steering positions 70, 74 to provide forward or reverse movement of the wheels 14, 16. The drive shaft contactor 80 is biased into frictional engagement with the cam 78 using springs 81, as illustrated with reference to FIGS. 11 and 13. The pinion gear 72 engages the primary wheel gear 60 of the second wheel 16 in a forward moving of the pool cleaner 10, and in a steering movement, the pinion gear engages the secondary wheel gear 62 which results in reverse rotation of the second wheel 16. The intermittent movement of the drive shaft contactor 80 moves the drive shaft one end 68 and its pinion gear 72 which interrupts the synchronized rotation of the drive wheels 14, 16 and causes a turning of the pool cleaner 10. The cam 78 is rotatably supported on an extension of the rotor 38, as are the reduction gears 84 used for reducing rotational speed such that the cam 78 turns at a slower rate and provide the intermittent movement for a desirable period.

In a similar fashion, as above described with reference to FIGS. 10A and 11A for an alternate embodiment, the intermittent movement of the drive shaft contactor 80A moves the drive shaft one end 68A and its pinion gear 72A which interrupts the synchronized rotation of the drive wheel 16 and causes a turning of the pool cleaner 10. The cam 78A is rotatably supported on an extension of the rotor 38, as are the reduction gears 84A used for reducing rotational speed such that the cam 78A turns at a slower rate and provides the intermittent movement for a desirable preset period. Those of skill in the art will appreciate that the drive and steering mechanism for one wheel is generally a mirror image of that of the second wheel.

A tread element 88 is carried about the periphery of the drive wheels 14, 16 to provide traction on the pool surface 18 being cleaned. The tread element 88 in combination with the size of the drive wheels 14, 16 is larger in diameter than the housing 12 is high. This allows the pool cleaner 10 to ride over commonly encountered impediments and obstacles in a swimming pool.

With reference again to FIGS. 1 and 5, a protrusion 90 is affixed at a portion of the tread element 88 of each wheel 14, 16 and provides additional traction for dislodgement of the pool cleaner. The large wide wheels with one protrusion on each help dislodge the pool cleaner 10 in the event it gets stuck on objects in a pool. It has been found that when the pool cleaner is equipped with the independent wheel steering, it is likely that the protrusion 90 will not be necessary in some pool configurations, thus allowing the pool cleaner to transition and traverse the submerged surface of the pool with less interruption, and thus an improved performance.

Figure 4D:
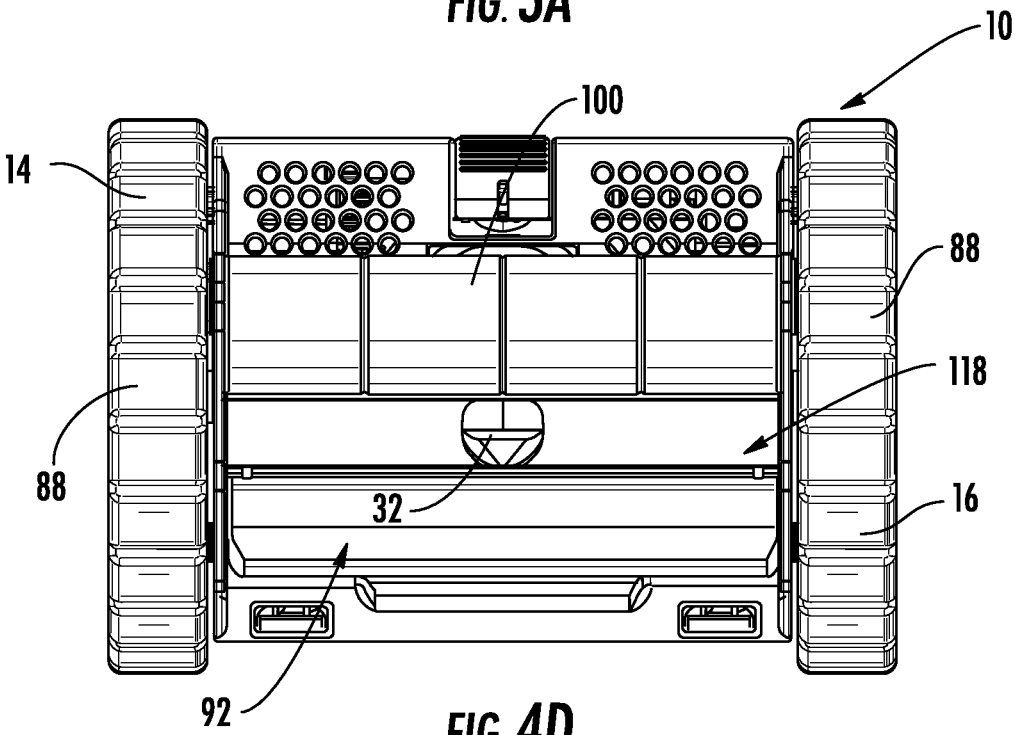
FIG. 4D is a bottom plan view of the embodiment of FIG. 3A.
Figure 4:
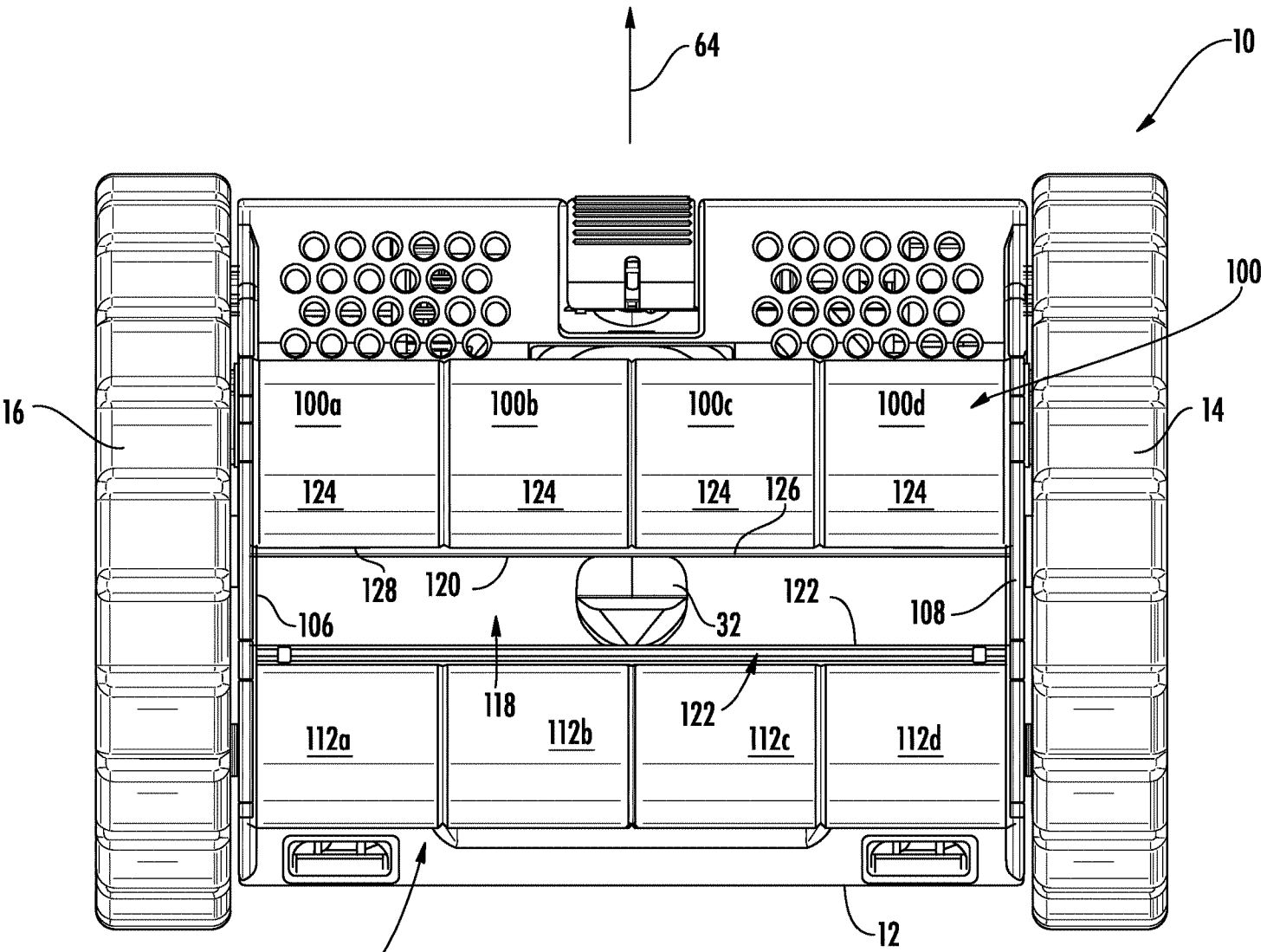
FIG. 4 is a bottom view of the embodiment of FIG. 1.
Figure 4A:
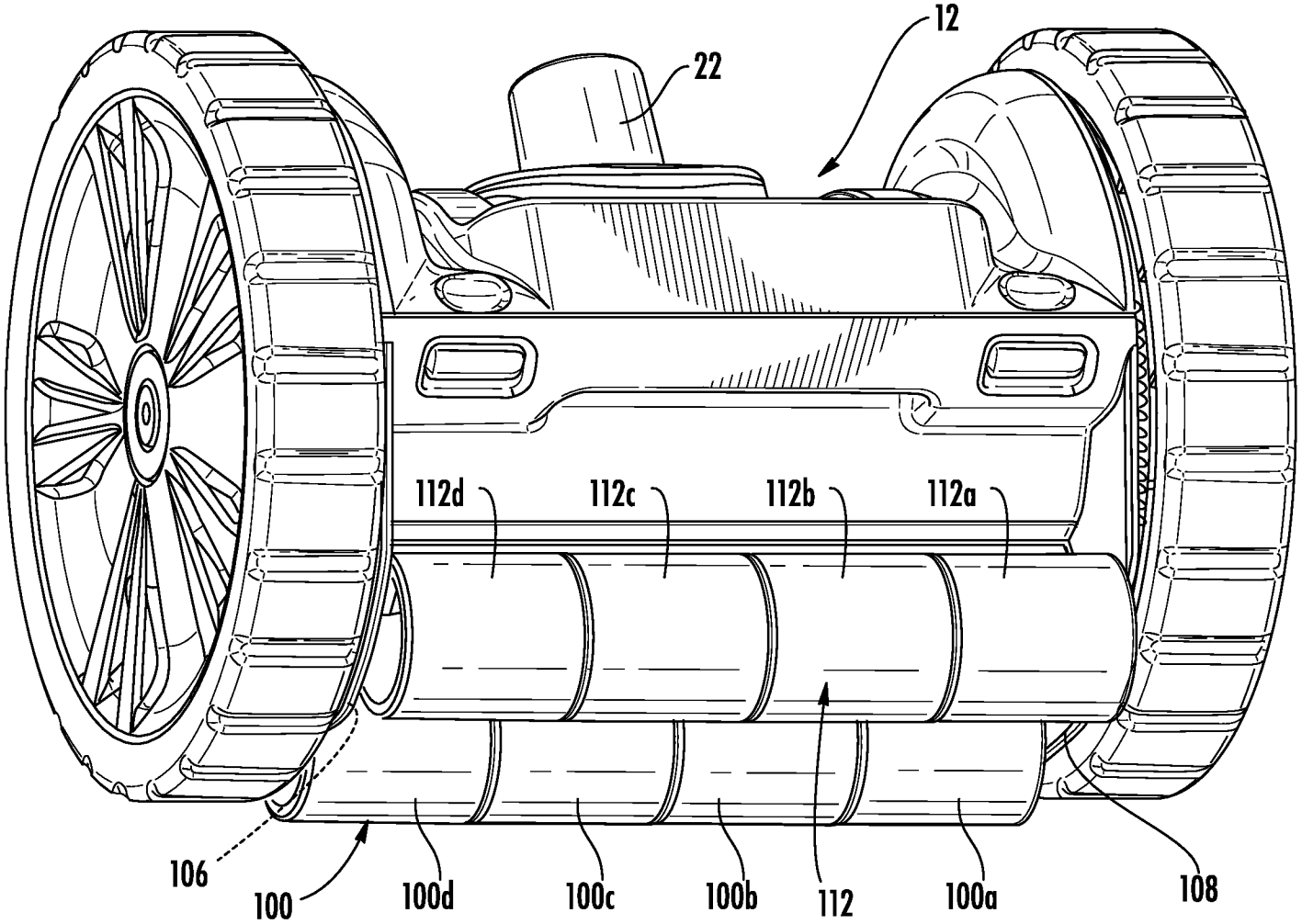
FIG. 4A is a bottom perspective of the embodiment of FIG. 1
Figure 4B:
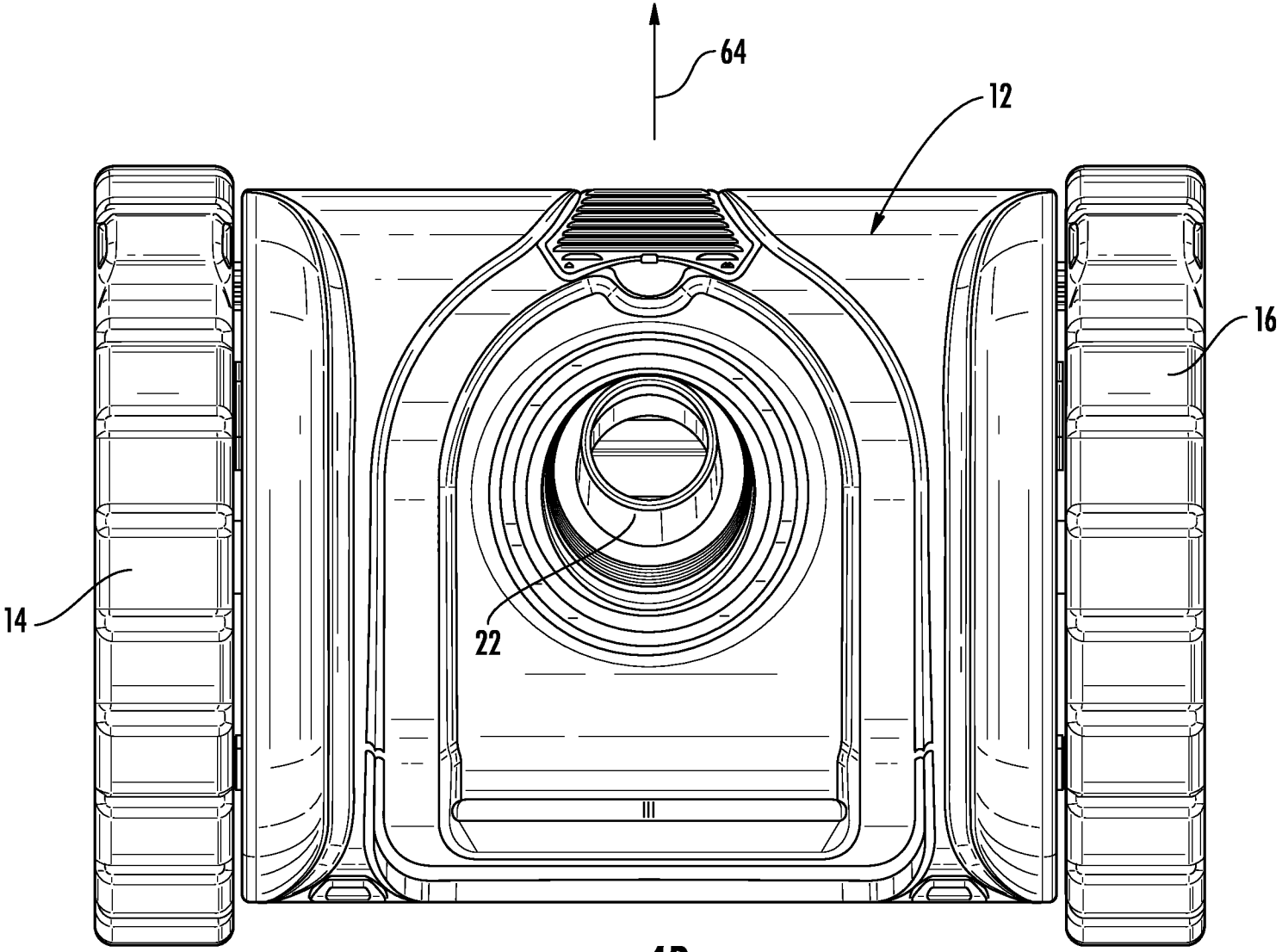
FIG. 4B is a top view of the embodiment of FIG. 1.
Figure 5A:
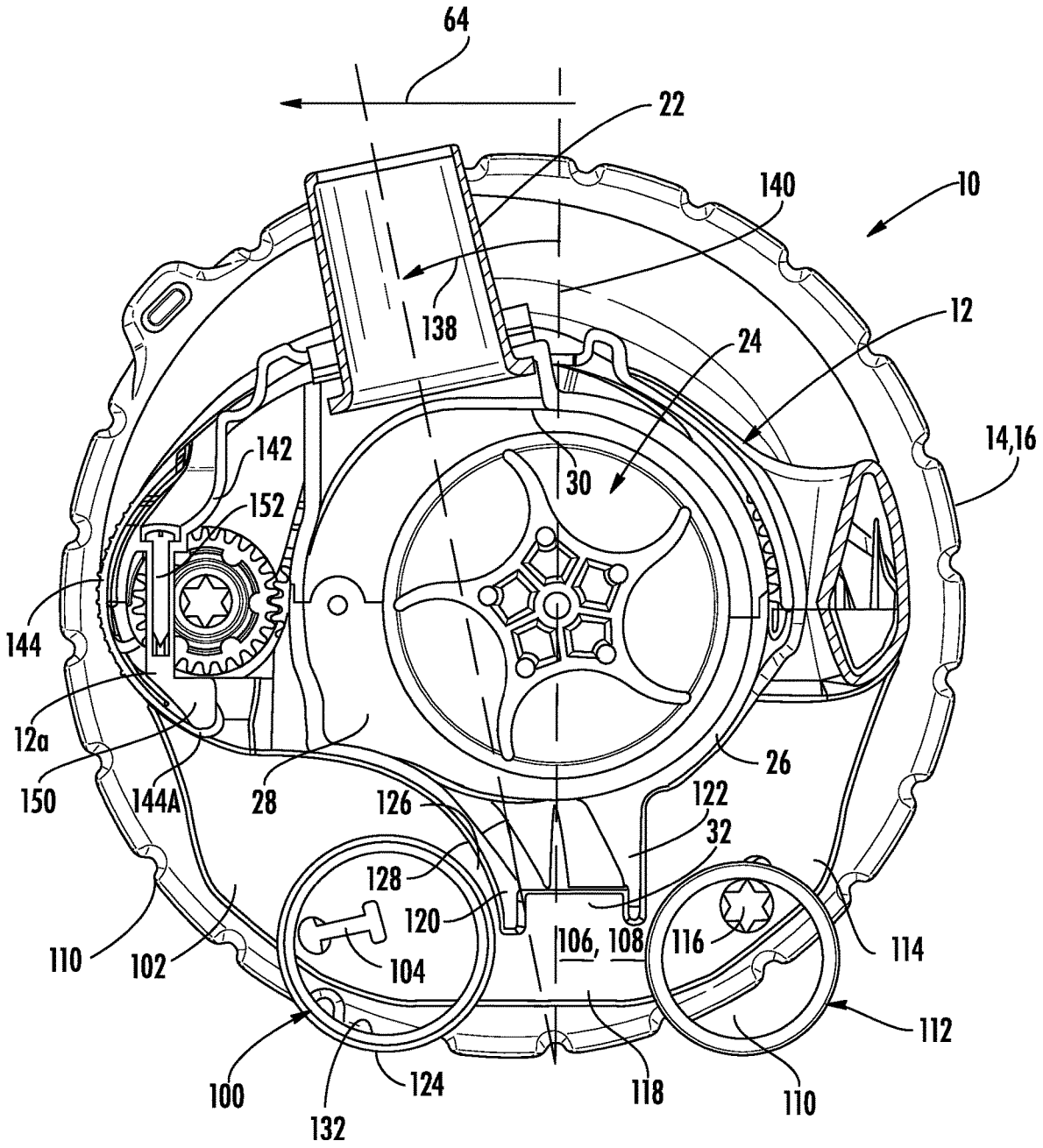
FIG. 5A is a cut-away side view taken through lines 5A-5A of FIG. 2 is a first position having forward and aft rollers extending outside a perimeter of the wheel.
Figure 5B:
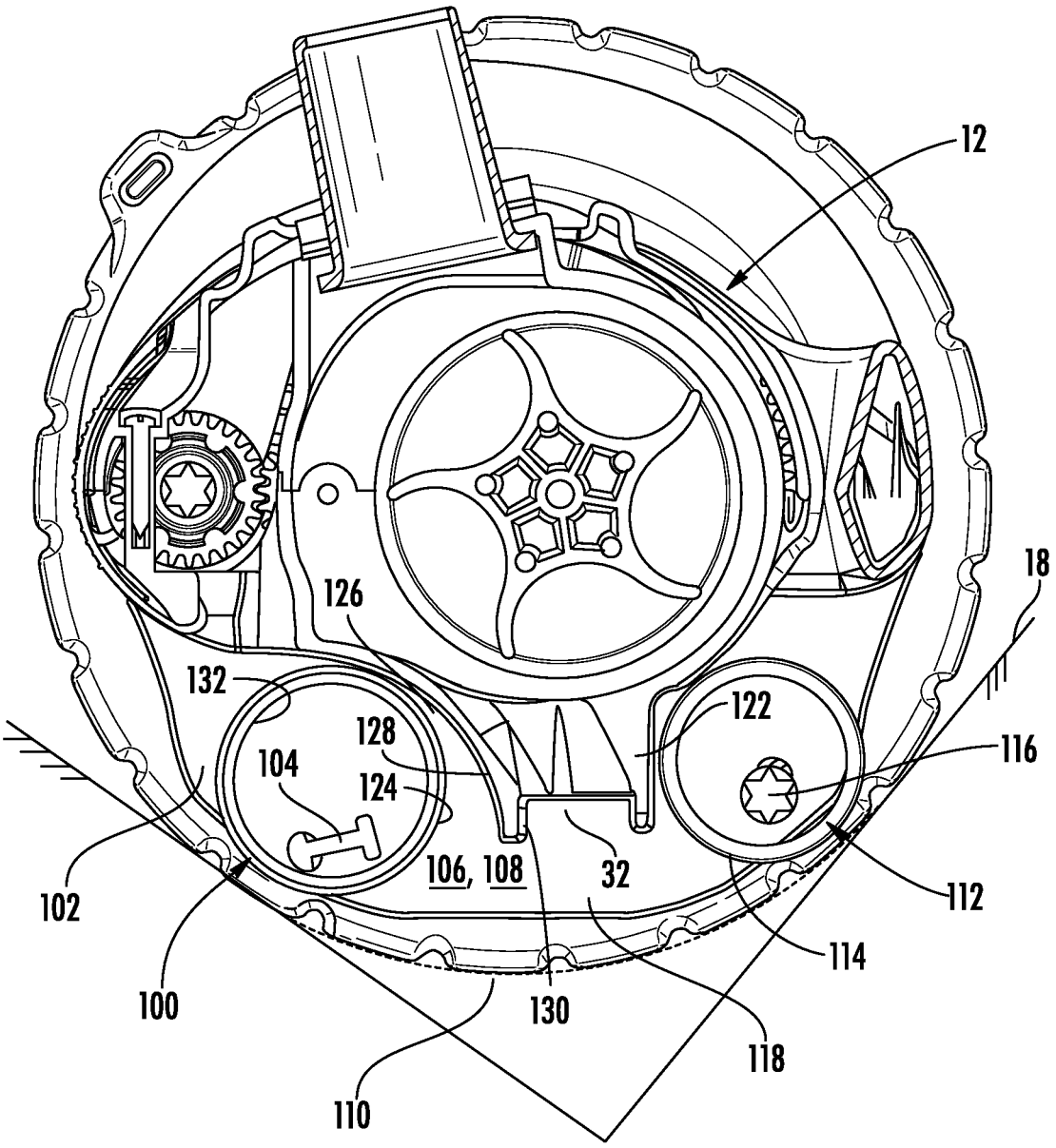
FIG. 5B a cut-away view illustrating the rollers retracted within the perimeter of the wheels.

With reference again to FIGS. 1 and 2 and now to FIGS. 4A and 5A, by way of example, a first roller 100 is positioned on a forward bottom portion 102 of the housing 12 forward the inlet port 32, The first roller, herein a forward roller 100 is moveable about a first axle 104 carried between opposing side wall portions 106, 108 of the housing 12 for retracting within a perimeter 110 defined by radial outermost portions of the at least two wheels 14, 16, as further described with reference to FIG. 5B.

With continued reference to FIGS. 4A and 5A, a second roller 112 is positioned at an aft bottom portion 114 of the housing 12 aft the inlet port 32 and generally opposing the first roller 100. The second roller 112 (herein an aft roller) extends between the opposing side wall portions 106, 108 and is moveable about a second axle 116. The second roller 112 is moveable from outside the perimeter 110 for contact with the surface to be cleaned 18 to inside the perimeter, as illustrated with reference again to FIG. 5B, for permitting the second roller to roll along uneven portions of the submerged surface 18 to be cleaned. The first and second rollers 100, 112, in combination with the opposing side wall portions 106, 108 of the housing 12, form a plenum 118 for water, where the plenum of water enhances adherence of the pool cleaner to the submerged surface 18.

With reference again to FIGS. 1, 2 and 4A, by way of example, the rollers 100, 112 comprise multiple roller portions 100 *a, b, c, d* and 112 *a, b, c, d*, wherein each of the multiple roller portions moves independently of one another about the axles 104, 116, respectively, for generally conforming to the uneven portions of the surface 18 to be cleaned. Further, rollers 100, 112 are loosely rotatable about their respective axles 104, 116.

With reference again to FIGS. 4, 5A and 5B, a forward partition 120 and an aft partition 122 extend between the opposing side wall portions 106, 108. The forward partition 120 is fixed forward the inlet port 32 and the aft partition 122 is fixed aft the inlet port, wherein free ends of the partitions extend toward the perimeter 110 but only extend to inside the perimeter, thus spaced from the perimeter. An outer surface 124 of the first roller 100 continuously forms a fixed gap 126 with an outer surface 128 of the forward partition 120 during movement of the first roller 100 from outside to inside the perimeter 110, as further illustrated with reference again to FIG. 5B. As herein illustrated, the outer surface 128 of the forward partition 120 has an arcuate shape extending from the free end 130 of the forward partition toward the forward direction 64 of movement of the pool cleaner. As further illustrated, in one commercial embodiment, the rollers 100, 112 are formed from tubes having their inner surfaces loosely slidable along their respective axles during rotation. For the first roller 100, its inner surface 132 is dimensioned to maintain the gap 126 during movement of the first roller from outside the perimeter 110 to inside the perimeter. For providing reinforcement to the first axle 104, the first axle is formed as a rib having an elongate cross section, as illustrated with continued reference to FIG. 5A.

As above described with reference to the first and second rollers 100, 112, with use of the wiper element 92 instead of the second roller 112, the side wall portions 106, 108, front/first roller 100 and the wiper element 92 create the plenum 118 by essentially forming a skirt around the inlet port 32 enabling the cleaner 10 to have enhanced suction and thus enhanced attachment to the pool surface 18. Since the rollers 100, 112 move freely, they are able to retract within the outside perimeter 110 of the wheels 14, 16 and have little resistance which enables the cleaner 10 to desirably transition into steep or angled walls. As above described, the rollers 100, 112 having multiple segments moving independently of one another further enable them to conform to uneven surfaces in the pool. This also enables the cleaner 10 to navigate over obstacles such as bottom drains and larger debris. The rollers or roller and wiper in combination with the housing lower side wall portions keep the plenum substantially closed, thus providing a desirable flow and collection of debris from beneath the pool cleaner by a suction action.

As illustrated with reference again to FIGS. 5 and 12, the wiper element 92 comprises a hinge pin 134 slidable in an aperture 136 in the side wall portions 106, 108. The apertures 136, herein slots 136, allow the hinge pin 134 and thus the wiper element 92 to move up and down or in and out within and beyond the perimeter 110. The slot 136 allows the wiper element 92 to be recessed within the perimeter 110 of the wheels 14, 16, and thus avoid a locking against the surface 18 being cleaned which would be the case if the wiper element 92 were fixedly hinged. Those of skill in the art will appreciate that the aperture 136 may be an elongate hole, an oval, or the like, now having the benefit of the teachings of the present invention. The wiper element 92 is therefore able to conform to uneven surfaces. The retraction of the wiper element 92 enhances capability of the cleaner 10 to right itself. When in the process of righting itself, the wiper element 92, or the second roller 112 above described, will retract within the perimeter 110 of the wheels 14, 16 allowing the cleaner 10 to upright itself without obstruction. In an alternate embodiment, the wiper element comprises multiple elements operable with the hinge pin 134, as earlier described for the rollers 110, 112.

With continued reference to FIG. 5, the aft partition 122 is in close proximity to a proximal end of the wiper element, yet preferably not in frictional contact. Further, the outside surface of the roller 100 is in close proximity, yet preferably not in frictional contact with the forward partition 120, thus desirably maintaining the gap 126. Such an arrangement creates a sufficient seal for improved performance of the pool cleaner, as above described.

Figure 8A:
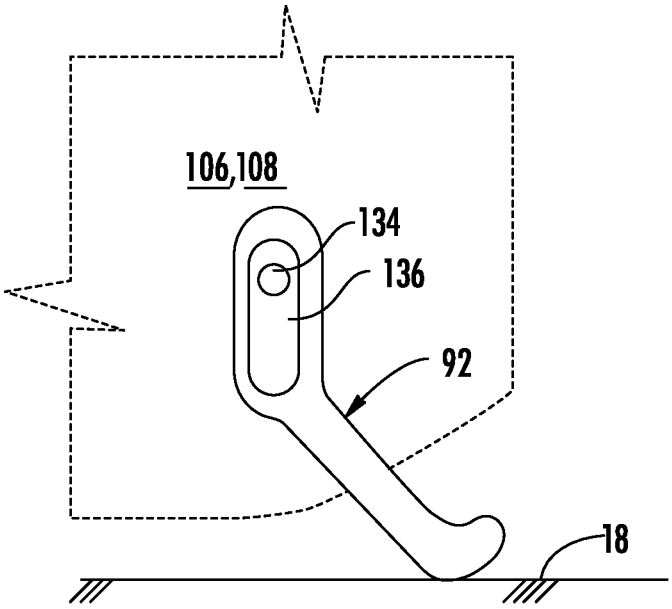
FIG. 8A is a partial end view of a flap having a slot for slidably receiving a hinge pin therein as an alternate embodiment.
Figure 9:
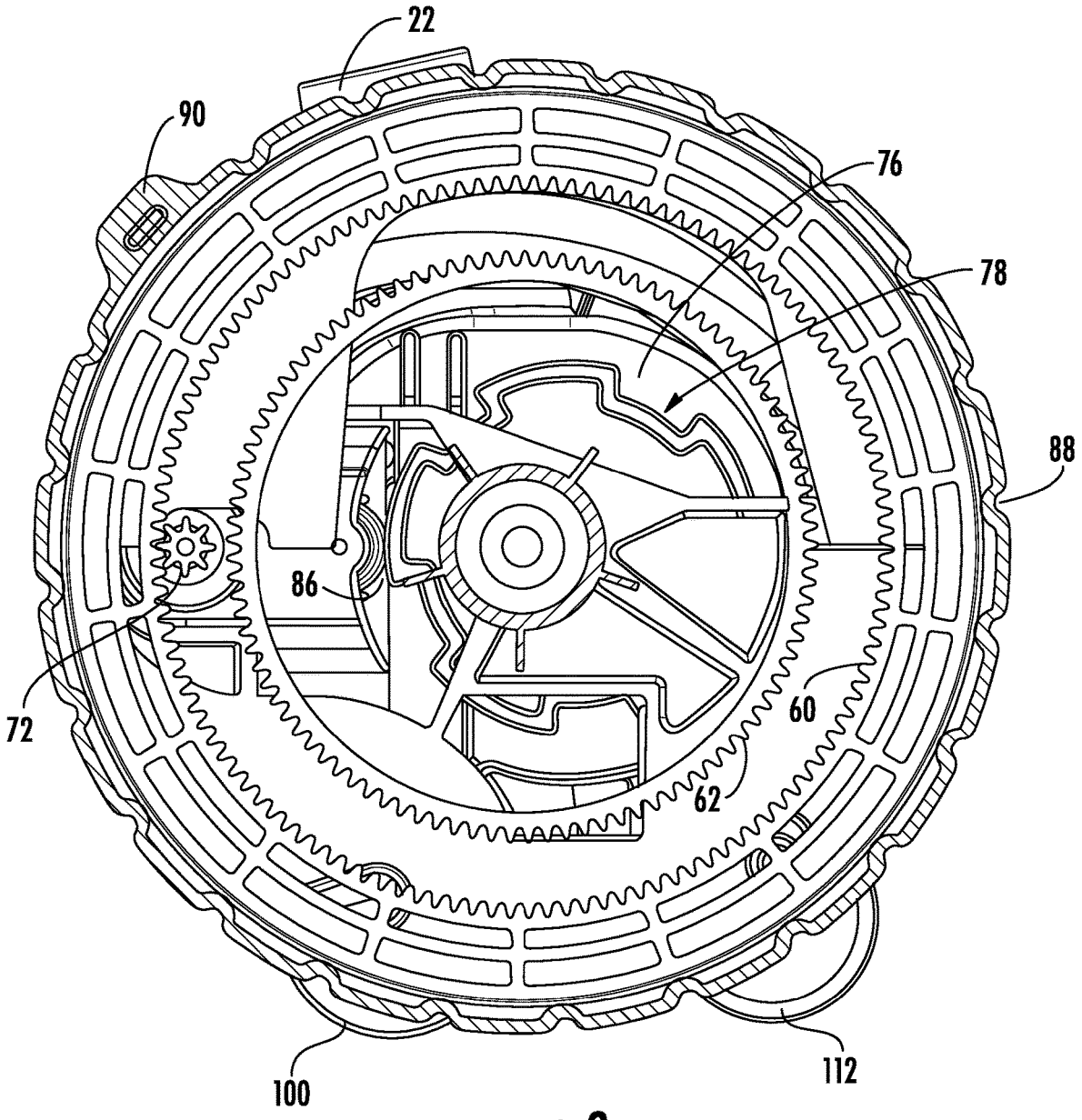
FIGS. 9 and 9A are cross-sectional views of FIGS. 1 and 3A, respectfully, proximate side portions including wheel and internal gearing portions within the housing.
Figure 9A:
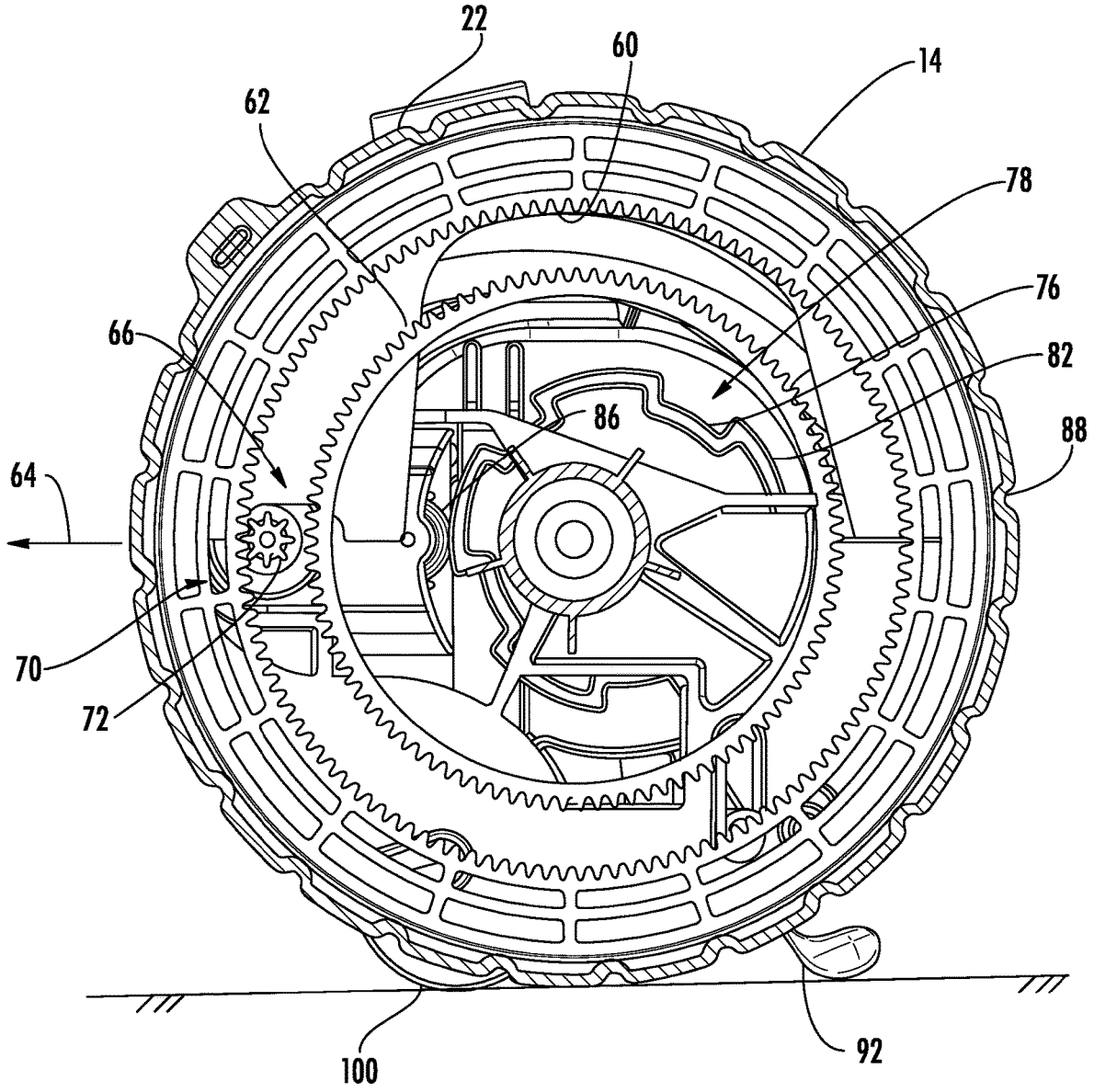

As will come to the mind of those skilled in the art, now having the benefit of the teachings of the present invention, one embodiment of the wiper element 92 may include the aperture as the slot 136 carried within the proximal end of the wiper element 92 and slidable along a fixed hinge pin, as illustrated with reference to FIG. 8A, wherein the hinge pin may be fixed to the side wall portions 106, 108 as earlier described.

Figure 4C:
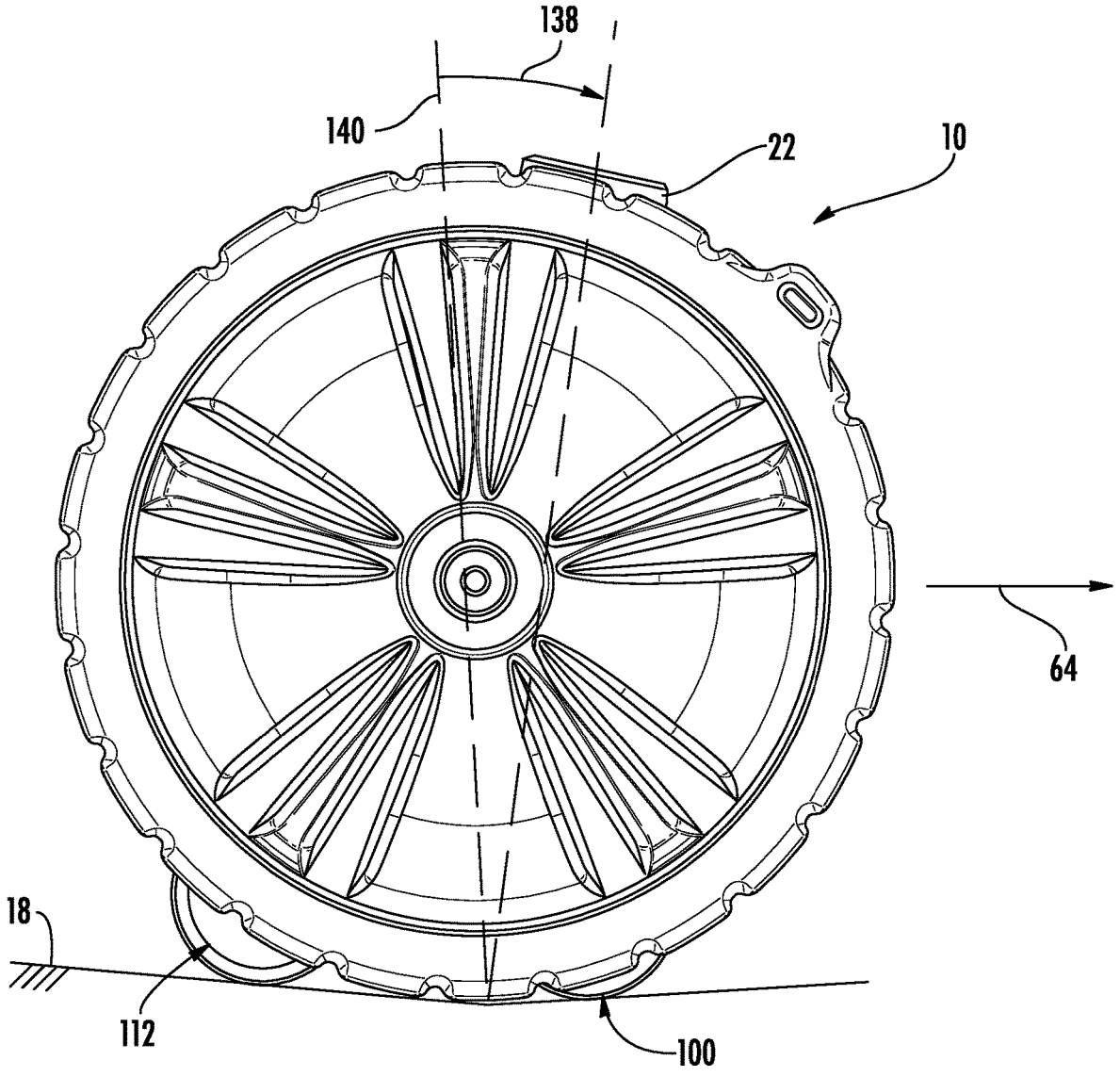
FIG. 4C is a side elevation view of the embodiment of FIG. 1.

Typical pool cleaners that are able to transition onto the pool side walls have problems climbing above the water line and therefore suck air which is well known to be detrimental for the pump. The embodiment of the pool cleaner 10, herein described by way of example, solves this problem by forwardly angling 138 the hose connector 22 relative to an upright position 140 of the pool cleaner during normal operation, as illustrated with reference again to FIGS. 4C and 5A. As a result of the forwardly angled 140 hose connector 22, when the cleaner 10 climbs a side wall, the hose 20 will be placed slightly ahead of the cleaner 10. Since the hose 20 is full of water during operation of the cleaner 10, the hose acts as a weight forcing the cleaner to generally stay submerged and below the water surface level of the pool, thus preventing the pool cleaner from adversely sucking air.

Figure 16:
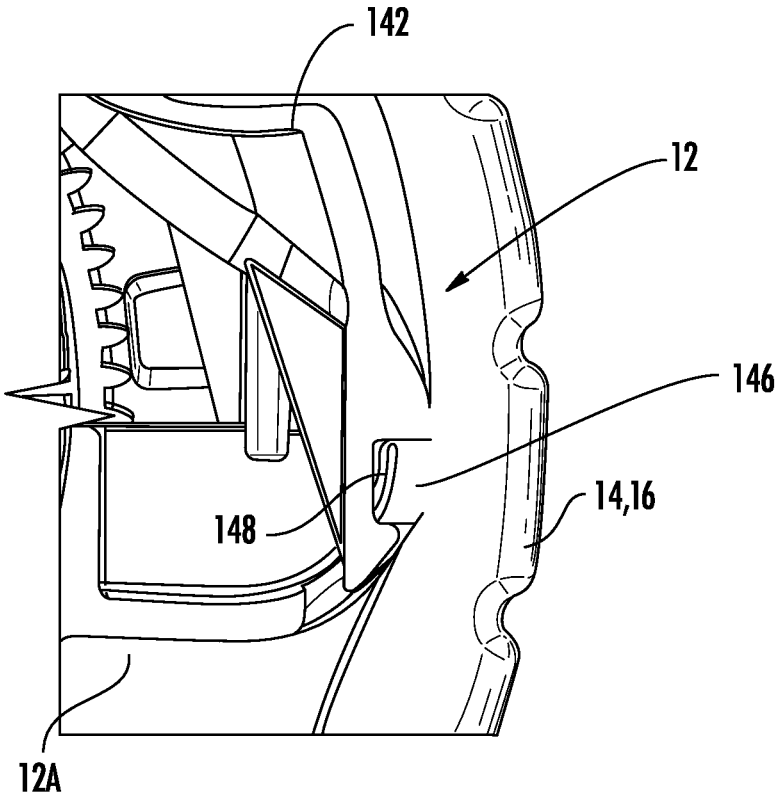
FIG. 16 is a partial cross-sectional view illustrating a rearward portion of the swimming pool cleaner housing and connection to a wall of housing portion thereof.
Figure 15A:
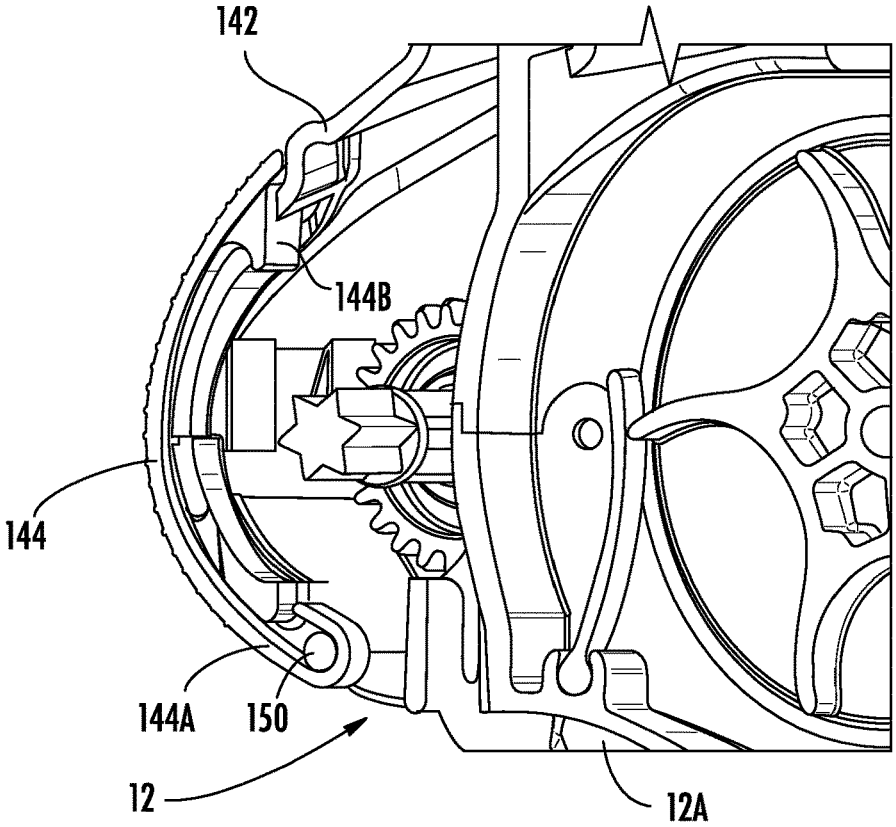
FIGS. 15A and 15B are partial perspective and side cross-sectional views, respectively, of internal portions of the pool cleaner of FIG. 1, illustrating a latch connection for securing a housing cover onto a lower body portion.
Figure 15B:
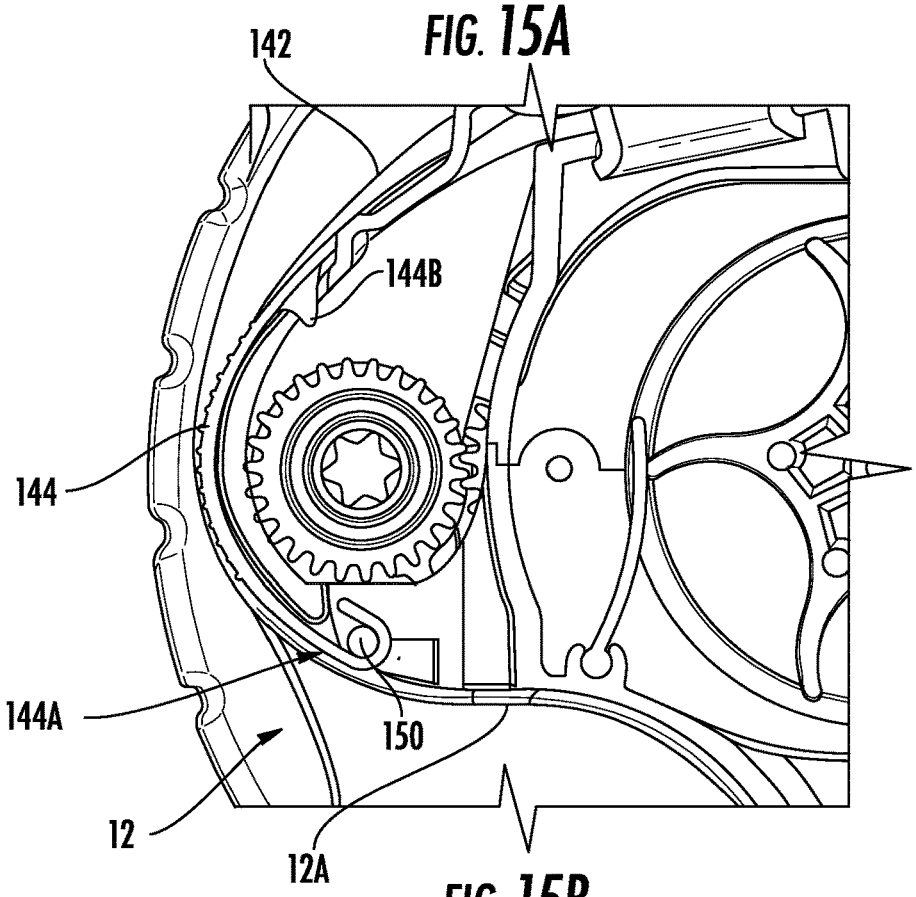

As illustrated with reference again to FIGS. 1 and 3, and now to FIGS. 15A, 15B and 16, the housing 12 comprises a top cover 142 connected to a housing bottom portion 12A with a front latch 144, rear tab 146 and slot 148. The tabs 146 are placed into the slots 148 on the rear portion of the body 12 of the pool cleaner 10. The cover 142 is then latched at the front end of the pool cleaner 10 using the front latch 144. As illustrated with continued reference to FIGS. 15A and 15B, the latch 144 comprises a hooked portion 144A at a lower end removably secured to a pin or optional detent 150 fixed to a lower portion 12A of the housing 12. An upper portion of the latch 144 comprises a protrusion 144B that is removably secured to a portion of the cover 142. A screw 152 may also be used to secure the top cover 142 to the lower housing portion 12A.

Many modifications and other embodiments of the invention will come to the mind of those skilled in the art now having the benefit of the teachings presented in the foregoing descriptions and associated drawings. Therefore, it is understood that the invention is not to be limited to specific embodiments disclosed, and that modifications and embodiments are intended to be included within the scope of the appended claims.

That which is claimed is:

1. A pool cleaner comprising:

a housing having an inlet port for receiving water and debris, an outlet port, and opposing sidewalls;

a turbine within the housing;

a first wheel and a second wheel positioned on opposed sides of the housing and operably connected to the turbine in such a way that the turbine drives the first wheel and second wheel, the first wheel and second wheel having an outer diameter defining an outer perimeter thereof; and a flap positioned at a bottom portion of the housing adjacent the inlet port, the flap forming at least a portion of a plenum for water that suctions the pool cleaner to a pool surface to be cleaned, the flap extending between the opposing sidewalls and being retractable within a slot formed in the housing, the flap having a bottom surface that is moveable from outside the outer perimeter for contact with the pool surface to be cleaned to inside the outer perimeter for permitting the flap to slide along uneven portions of the pool surface to be cleaned by moving up and down within the slot.

2. The pool cleaner of claim 1, further comprising a forward partition and an aft partition extending between the opposing sidewalls, the forward partition being fixed forward the inlet port and the aft partition fixed aft the inlet port, wherein a free end of the forward partition and a free end of the aft partition extend toward the outer perimeter and are spaced therefrom.

3. The pool cleaner of claim 1, wherein the inlet port is located within a recess formed on the bottom portion of the housing, the recess extending between the opposing sidewalls, the recess being defined by a forward partition forward the inlet port and an aft partition aft the inlet port.

4. The pool cleaner of claim 1, wherein the turbine is operable to drive a drivetrain connecting the turbine to the first wheel and second wheel, the drivetrain including a reduction gear that controls rotation of a cam that steers the pool cleaner.

5. The pool cleaner of claim 1, wherein the slot extends though the opposing sidewalls.

6. The pool cleaner of claim 1, wherein the flap is forward the inlet port.

7. A pool cleaner comprising:

a housing having an inlet port for receiving water and debris, and an outlet port;

at least two wheels carried by the housing for rolling along a submerged surface to be cleaned, wherein an outer diameter of the at least two wheels defines a perimeter thereof;

a tubular member positioned on a bottom portion of the housing forward the inlet port, the tubular member defined by an inner surface;

a first axle carried between opposing side wall portions of the housing, wherein the inner surface of the tubular member is rotatable about the first axle, and wherein an outside dimension of the first axle is smaller than a diameter of the inner surface thereby permitting a portion of the tubular member to extend beyond the perimeter and retract within the perimeter responsive to movement along the submerged surface; and a retractable element positioned on the bottom portion of the housing aft the inlet port and generally opposing the tubular member, the retractable element extending between the opposing side wall portions and being moveable about a second axle, from outside the perimeter for contact with the submerged surface to be cleaned to inside the perimeter for permitting the retractable element to slide along uneven portions of the submerged surface to be cleaned, wherein the retractable element and the tubular member in combination with the opposing side wall portions of the housing form a plenum for water that enhances adherence of the pool cleaner to the submerged surface to be cleaned.

8. The pool cleaner of claim 7, wherein the at least two wheels comprise only two wheels.

9. The pool cleaner of claim 7, wherein the tubular member includes multiple portions, and wherein each of the multiple portions moves independently of one another about the first axle for generally conforming to the uneven portions of the submerged surface to be cleaned.

10. The pool cleaner of claim 7, further comprising a forward partition and an aft partition extending between the opposing side wall portions, the forward partition being fixed forward the inlet port and the aft partition fixed aft the inlet port, wherein a free end of the forward partition and a free end of the aft partition extend toward the perimeter and are spaced therefrom.

11. The pool cleaner of claim 10, wherein an outer surface of the tubular member is maintained out of contact with the forward partition.

12. The pool cleaner of claim 10, wherein an outer surface of the forward partition includes a concave shape extending from the free end of the forward partition toward a forward direction of movement of the pool cleaner.

13. The pool cleaner of claim 7, wherein the retractable element comprises a flap rotatable about the second axle, and wherein at least one of the second axle and the flap is slidable within slots formed within at least one of the side wall portions and the flap.

14. The pool cleaner according to claim 7, wherein the tubular member includes a roller.

15. The pool cleaner of claim 7, further comprising a turbine providing a driving force to the at least two wheels.

16. A pool cleaner driven by a flow of water therethrough for operation along a submerged surface to be cleaned, the pool cleaner comprising:

a housing having an inlet port for receiving water and debris therethrough, and an outlet port;

at least two wheels carried by the housing for rolling along a submerged surface to be cleaned, wherein an outer diameter of the at last two wheels defines a perimeter thereof;

a first roller positioned on a bottom portion of the housing forward the inlet port, the first roller having a tubular shape defined by an outer surface and an inner surface;

a first axle carried between opposing side wall portions of the housing, the inner surface of the first roller being rotatable about the first axle, and wherein an outside dimension of the first axle being smaller than a diameter of the inner surface thereby permitting the first roller to extend beyond the perimeter and to retract within the perimeter responsive to movement along the submerged surface; and a second roller positioned at the bottom portion of the housing aft the inlet port and generally opposing the first roller, the second roller extending between the opposing side wall portions and moveable about a second axle, the second roller moveable from outside the perimeter for contact with the submerged surface to be cleaned to inside the perimeter thereby permitting the second roller to roll along uneven portions of the submerged surface to be cleaned;

wherein the first and second rollers, in combination with the opposing side wall portions of the housing, form a plenum for water, the plenum enhancing adherence of the pool cleaner to the submerged surface to be cleaned.

17. The pool cleaner of claim 16, wherein the first roller comprises multiple roller portions, and wherein each of the multiple roller portions moves independently of one another about the first axle for generally conforming to the uneven portions of the submerged surface to be cleaned.

18. The pool cleaner of claim 16, wherein the first axle is attached to the side wall portions.

19. The pool cleaner of claim 16, further comprising a forward partition and an aft partition extending between the opposing side wall portions, the forward partition being fixed forward the inlet port and the aft partition fixed aft the inlet port, wherein respective free ends of the forward partition and aft partition extend toward the perimeter and are spaced therefrom.

20. The pool cleaner of claim 19, wherein the outer surface of the first roller is maintained out of contact with the forward partition during movement thereof.

21. The pool cleaner of claim 19, wherein an outer surface of the forward partition has a concave shape extending from the free end thereof toward a forward direction of movement of the pool cleaner.

22. The pool cleaner of claim 16, wherein the second roller comprises multiple second roller portions independently moveable about the second axle.

23. The pool cleaner of claim 16, wherein the second roller comprises a tubular shape and an inner surface slidable about the second axle.

* * * * *